US010494059B2

(12) United States Patent
Lee

(10) Patent No.: US 10,494,059 B2
(45) Date of Patent: Dec. 3, 2019

(54) SYSTEM FOR MONITORING OR CONTROLLING IMPACT LOAD RESULTING FROM FLUID UNDER INTERNAL/EXTERNAL FORCE IN SPECIFIC ENVIRONMENT

(71) Applicant: CYTRONIQ CO., LTD., Cheonan, Chungcheongnam-Do (KR)

(72) Inventor: Michael MyungSub Lee, Seoul (KR)

(73) Assignee: CYTRONIQ CO. LTD, Seobuk-Gu, Cheonan, Chungcheongnam-Do (KR)

( * ) Notice: Subject to any disclaimer, the term of this patent is extended or adjusted under 35 U.S.C. 154(b) by 590 days.

(21) Appl. No.: 14/965,218

(22) Filed: Dec. 10, 2015

(65) Prior Publication Data

US 2016/0229492 A1 Aug. 11, 2016

Related U.S. Application Data

(63) Continuation of application No. PCT/KR2015/002148, filed on Mar. 5, 2014.

(30) Foreign Application Priority Data

Mar. 5, 2014 (KR) ..... 10-2014-0026086

(51) Int. Cl.
*B63B 25/08* (2006.01)
*B63B 9/00* (2006.01)
*B63J 99/00* (2009.01)

(52) U.S. Cl.
CPC ..... *B63B 9/00* (2013.01); *B63B 25/08* (2013.01); *B63B 2710/00* (2013.01);
(Continued)

(58) Field of Classification Search
CPC ... B63B 9/00; B63B 25/08; F17C 2250/0443; F17C 2260/016; B65D 90/52
(Continued)

(56) References Cited

U.S. PATENT DOCUMENTS

2011/0278305 A1* 11/2011 Chun ..... B65D 90/52 220/563
2013/0112693 A1* 5/2013 Shin ..... B63B 25/08 220/563
2015/0020604 A1* 1/2015 Lee ..... G01B 11/16 73/800

FOREIGN PATENT DOCUMENTS

JP 2008213886 A * 9/2008
KR 101162469 B1 * 7/2012 ..... G01B 11/16
(Continued)

OTHER PUBLICATIONS

English Translation: Lee, KR 101162469 B1, dated Jul. 2012, Korean Patent Office Publication (Year: 2012).*
(Continued)

*Primary Examiner* — Nadeem Odeh
(74) *Attorney, Agent, or Firm* — Byungjoo Park

(57) ABSTRACT

A system that controls an impact load resulting from a fluid under an internal/external force is provided. The system senses an impact load, of a fluid under an internal/external force and attenuates the impact load. The present invention includes a floating means arranged horizontally inside an amount of fluid in an open space or in a sealed interior, a position adjustment means is vertically connected to the floating means and positioned inside the fluid, a sensing means disposed inside the fluid, on the floating means, the position adjustment means, or a structure in the periphery senses a measurement object. A controller predicts/monitors and predicts/controls fluid dynamics-related forces, hull stress, six-degree-of-freedom movements, and positions in connection with a transportation means or maritime structure. The floating means, the position adjustment means, and the sensing means are installed thereon, and use the value from the measurement object transmitted from the sensing means.

20 Claims, 45 Drawing Sheets

(52) U.S. Cl.
CPC ... *B63J 2099/006* (2013.01); *F17C 2250/032* (2013.01); *F17C 2250/043* (2013.01); *F17C 2250/0439* (2013.01); *F17C 2250/0465* (2013.01); *F17C 2250/0469* (2013.01); *F17C 2250/0482* (2013.01); *F17C 2250/0491* (2013.01); *F17C 2260/016* (2013.01); *F17C 2270/0105* (2013.01)

(58) Field of Classification Search
USPC ..... 701/21
See application file for complete search history.

(56) References Cited

FOREIGN PATENT DOCUMENTS

KR 20130012857 A * 2/2013
KR 20130060482 A * 6/2013

OTHER PUBLICATIONS

English Translation: Jeon, KR 20130012857 A, dated Feb. 2013, Korean Patent Office Publication (Year: 2013).*
English Translation: Imamura, JP 2008213886 A, dated Sep. 2008, Japanese Patent Office Publication (Year: 2008).*
English Translation: Lee Jae Kang, KR 20130060482 A1, dated Jun. 2013, Korean Patent Office Publication (Year: 2013).*

* cited by examiner

[Fig. 1a]
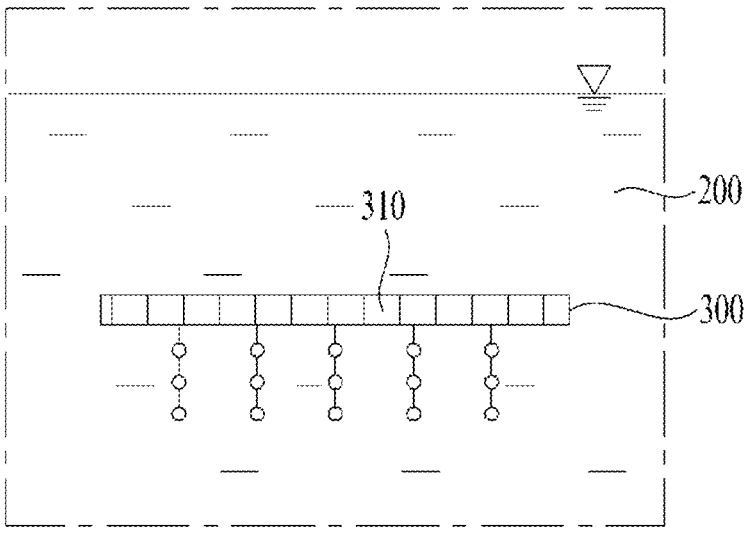
[Fig. 1b]
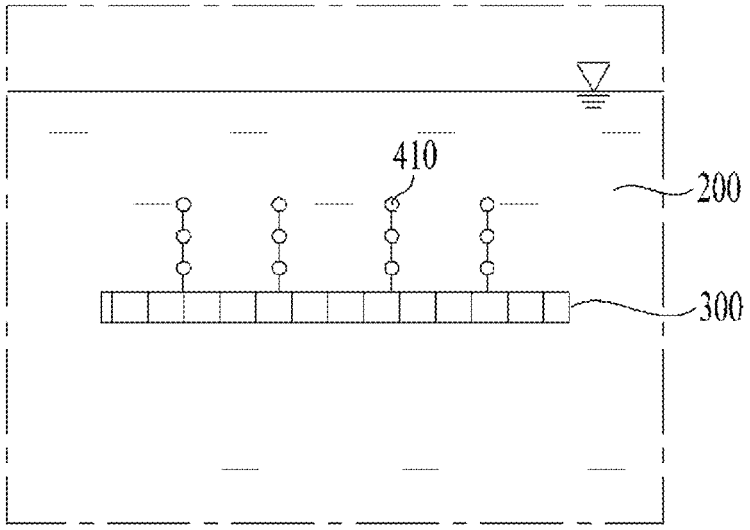

[Fig. 1c]
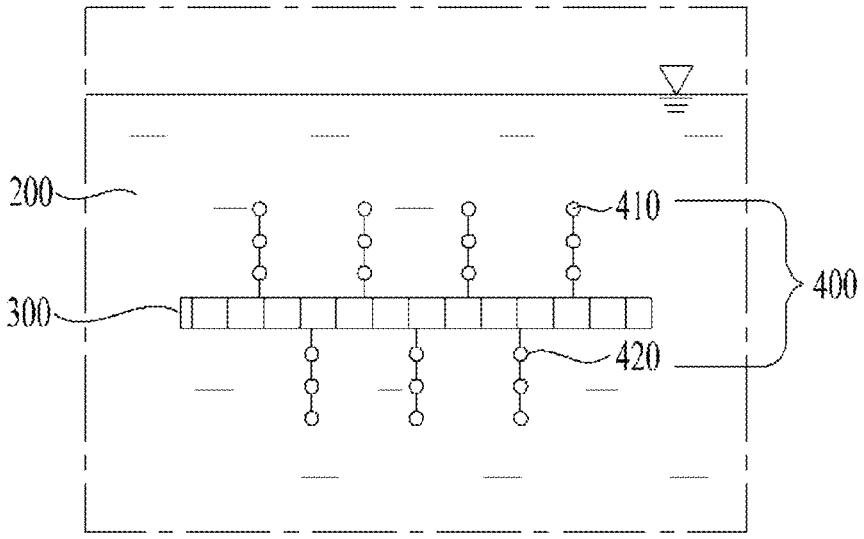
[Fig. 2a]
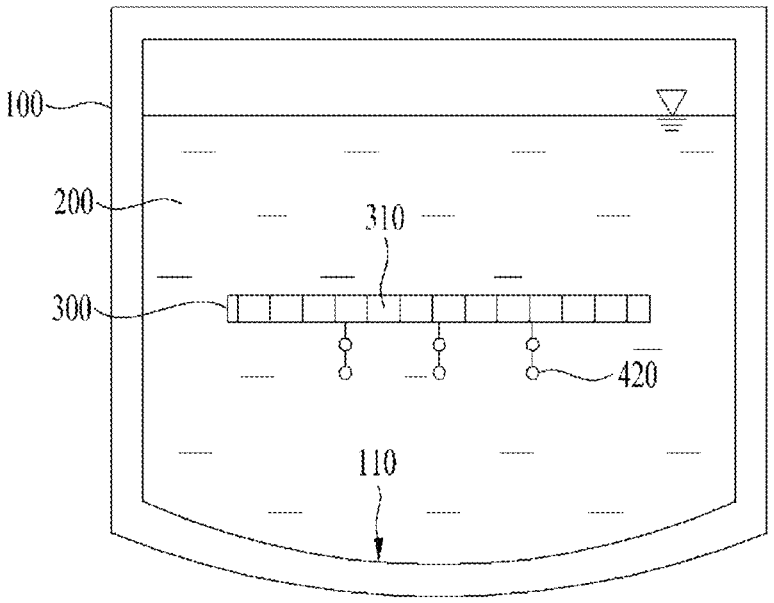

[Fig. 2b]
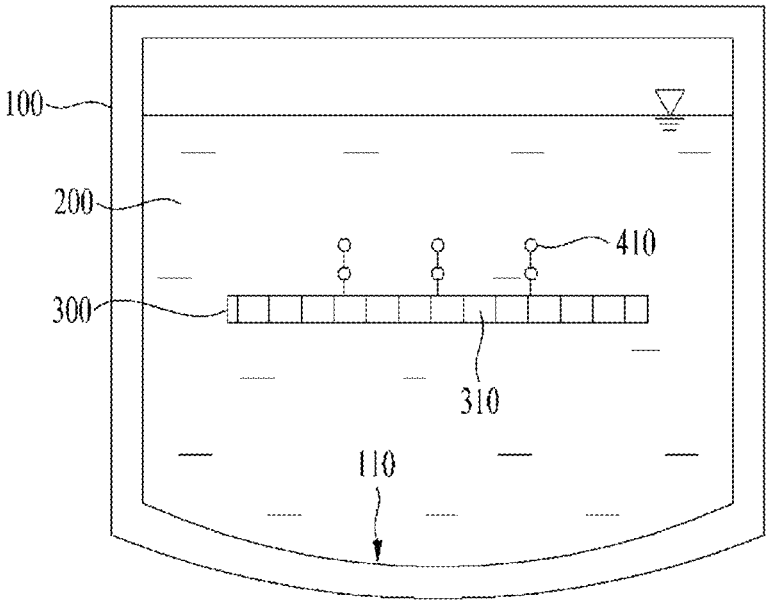
[Fig. 2c]
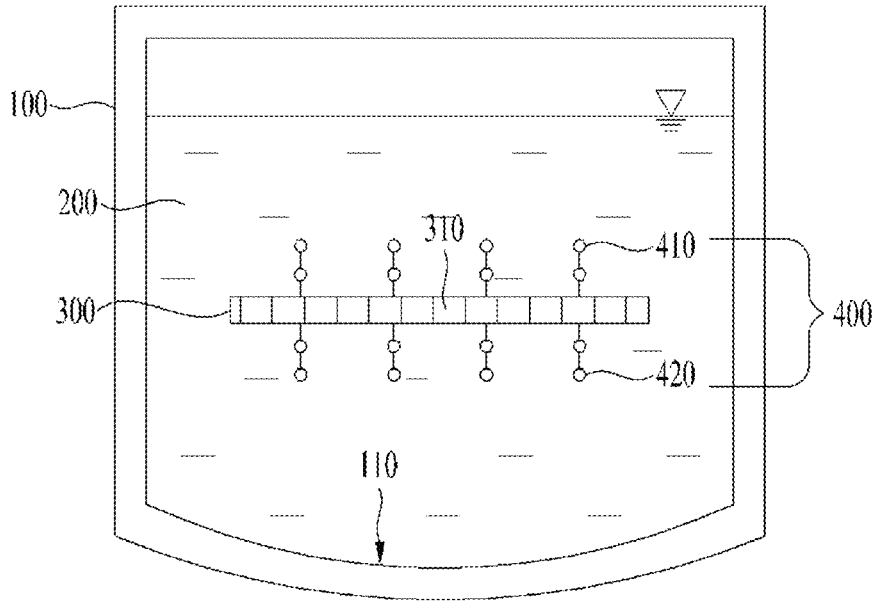

[Fig. 3a]
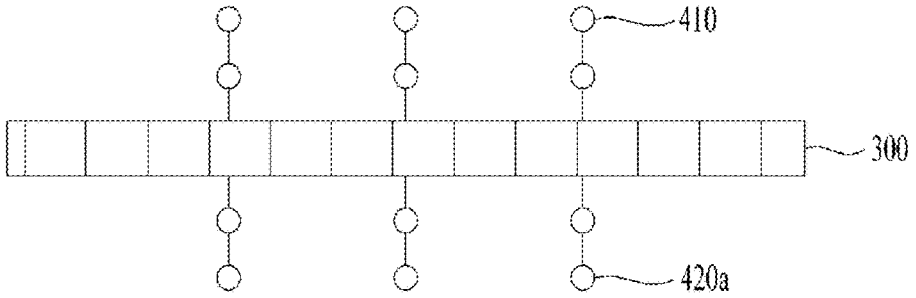
[Fig. 3b]
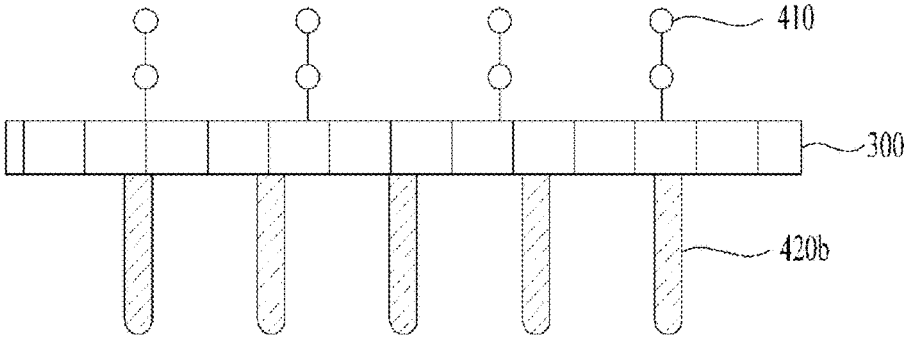
[Fig. 3c]
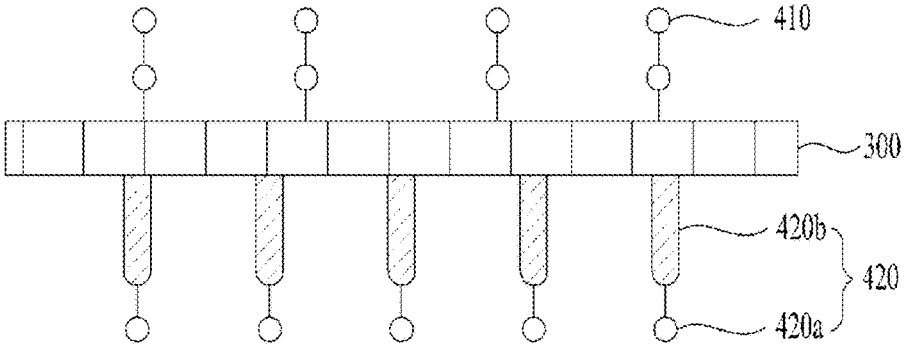

[Fig. 4a]
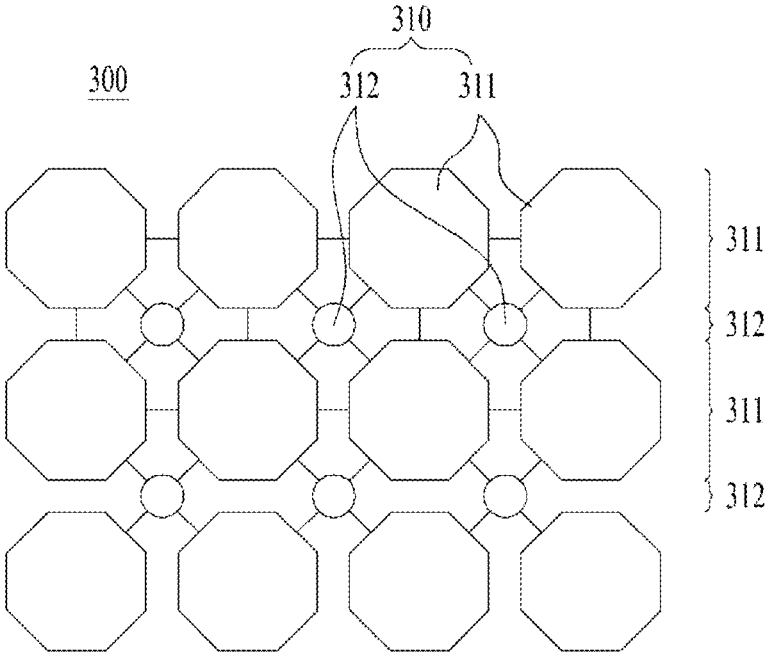
[Fig. 4b]
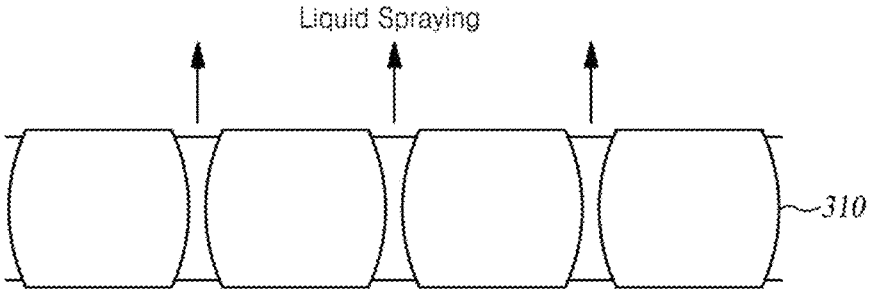

[Fig. 5]
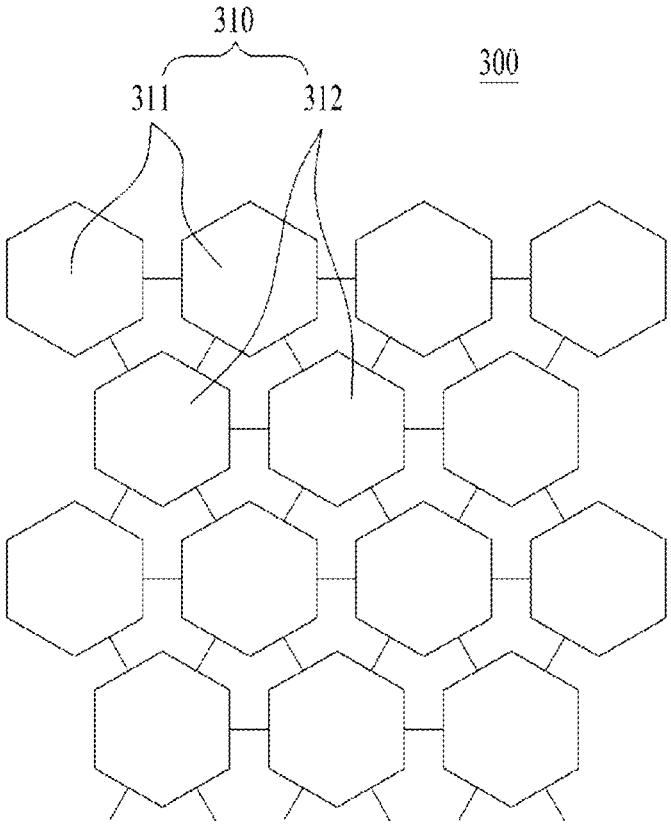

[Fig. 6a]
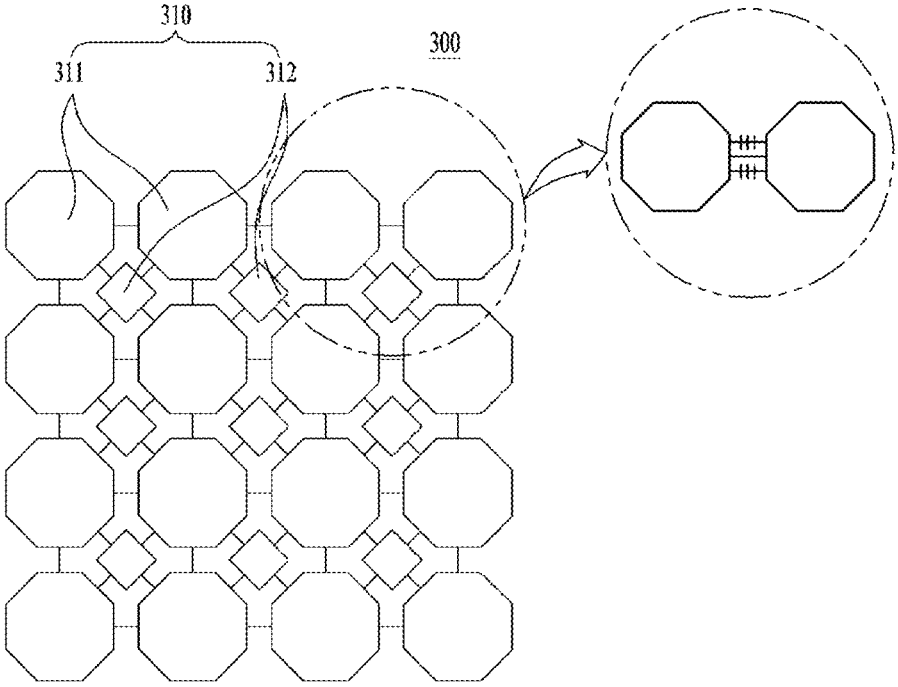

[Fig. 6b]
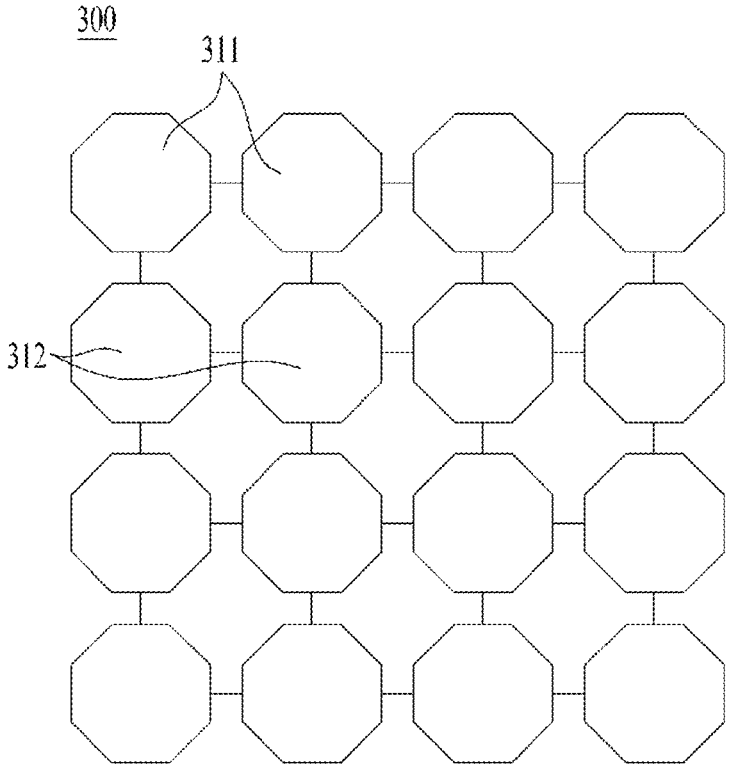

[Fig. 7a]
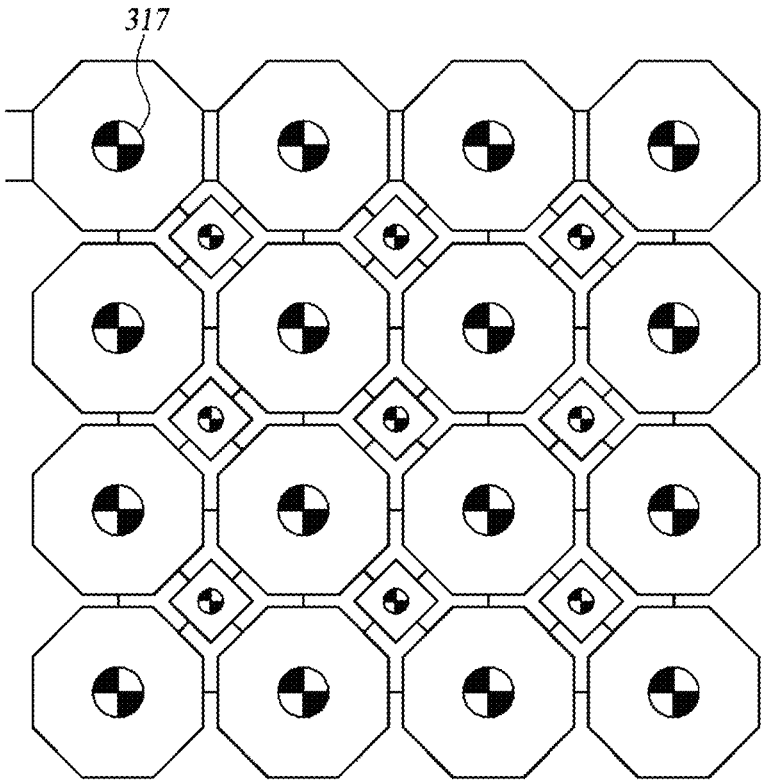
[Fig. 7b]
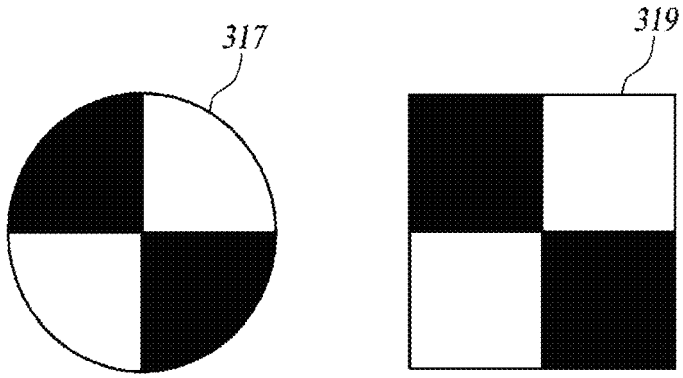

[Fig. 7c]
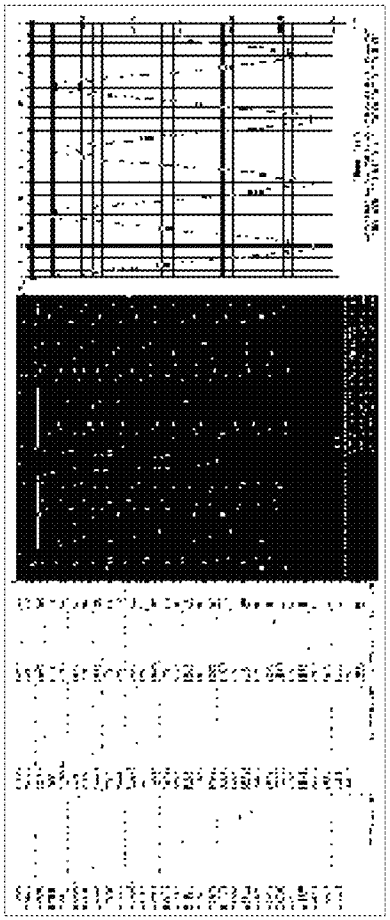
[Fig. 8]
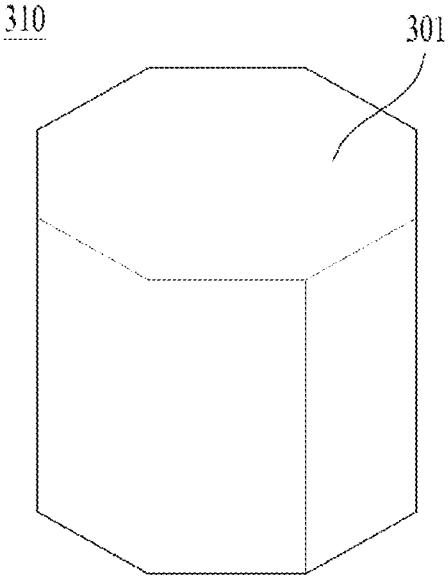

[Fig. 9a]
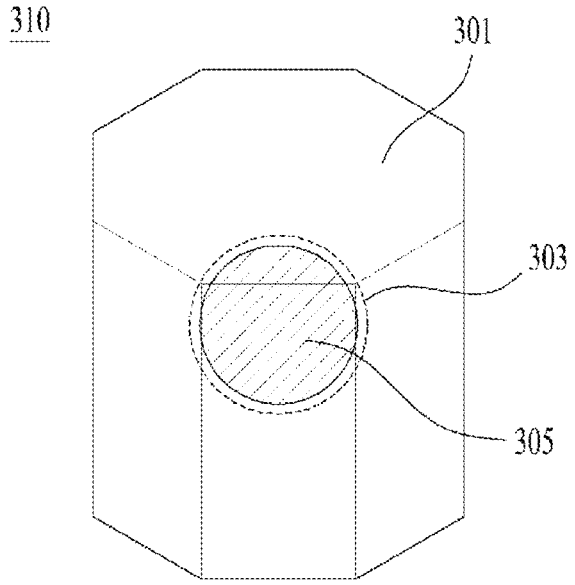
[Fig. 9b]
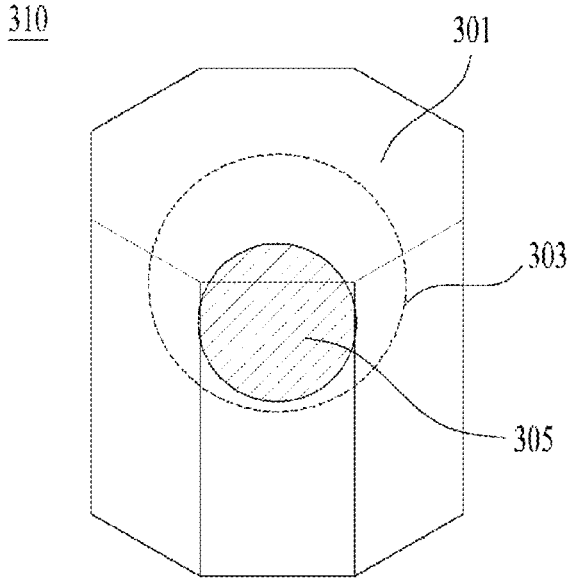

[Fig. 10]
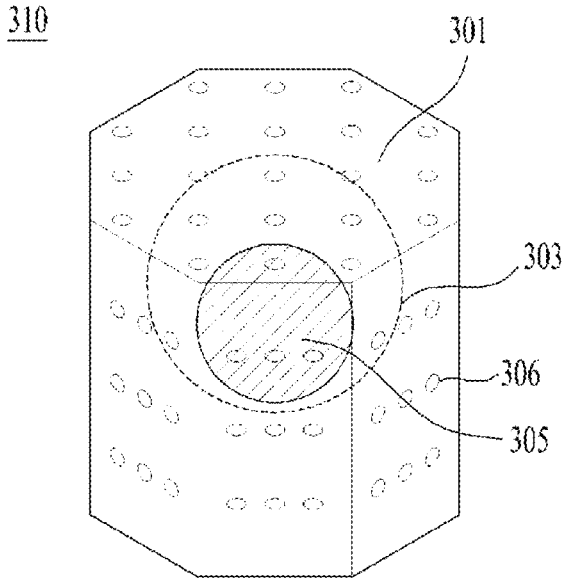

[Fig. 11a]
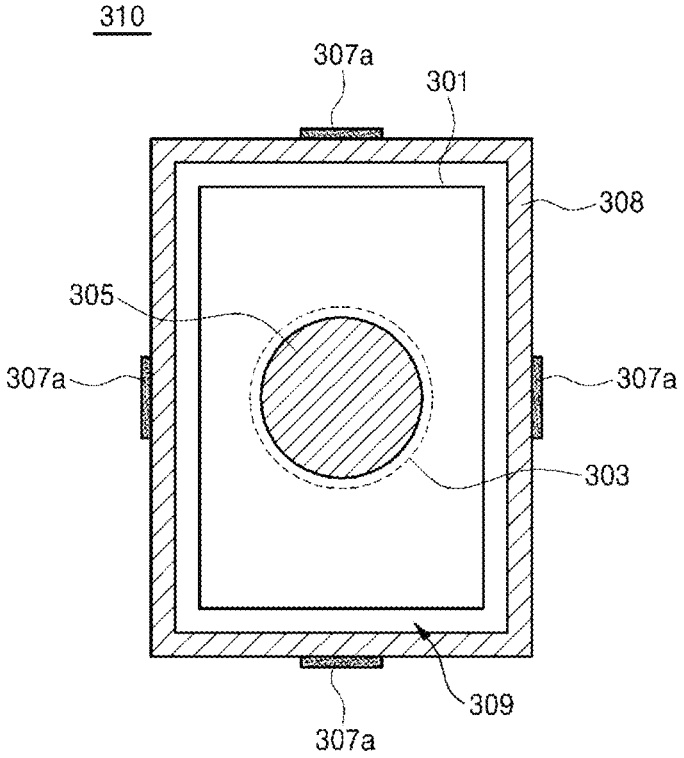

[Fig. 11b]
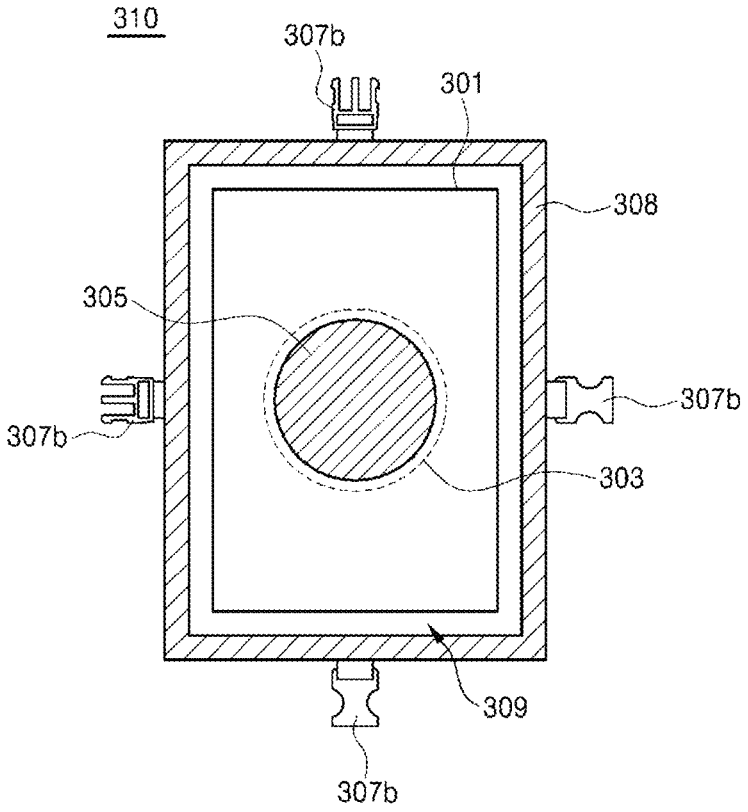

[Fig. 11c]
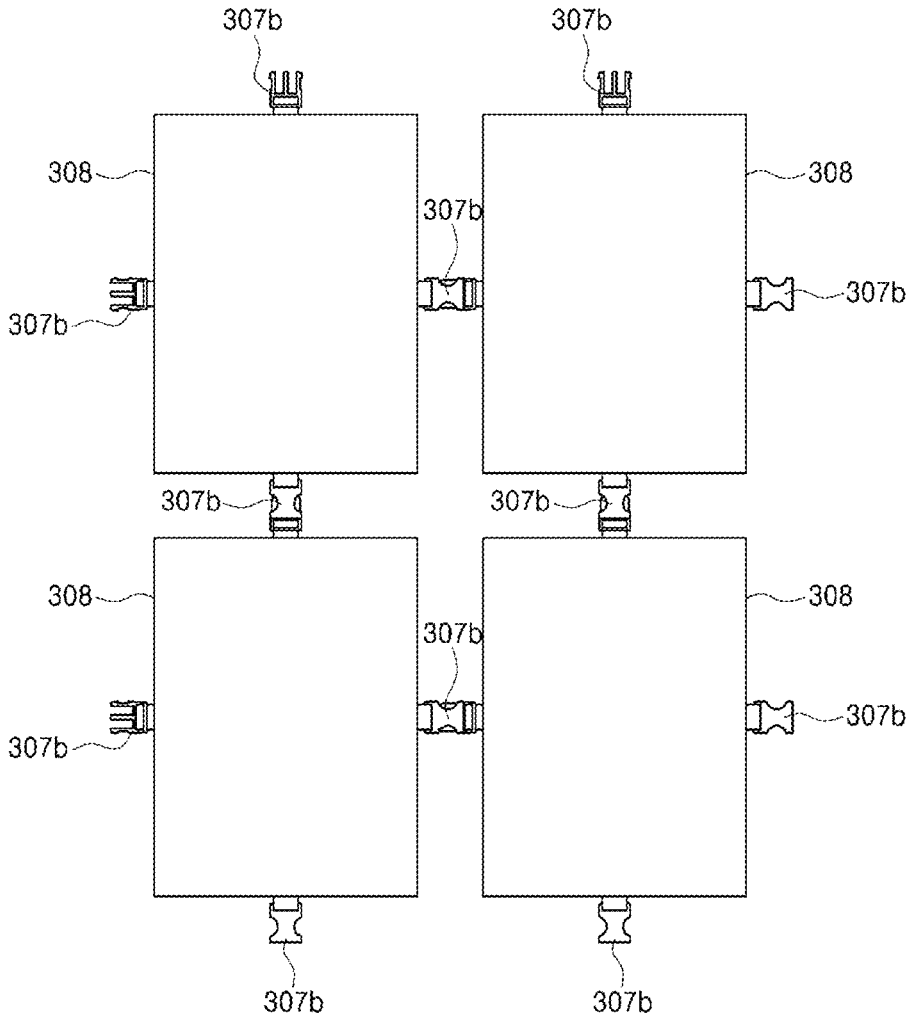

[Fig. 12]
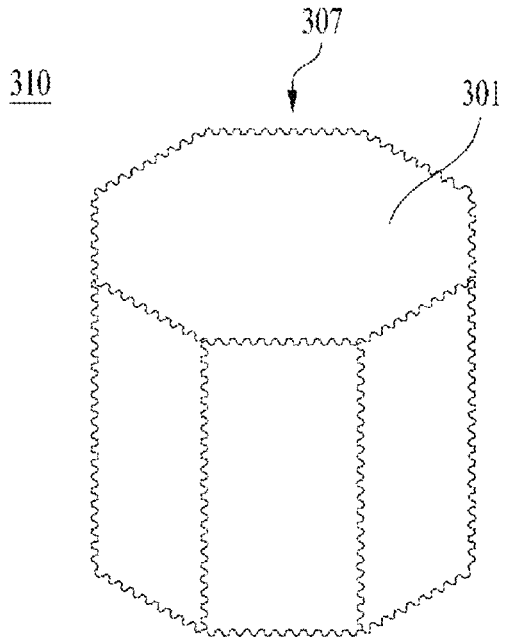

[Fig. 13a]
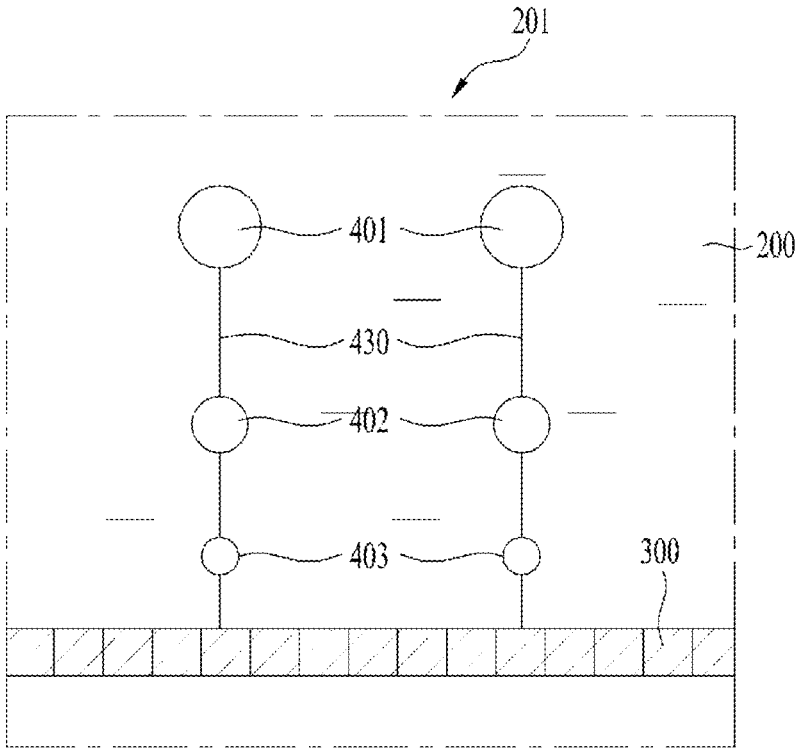

[Fig. 13b]
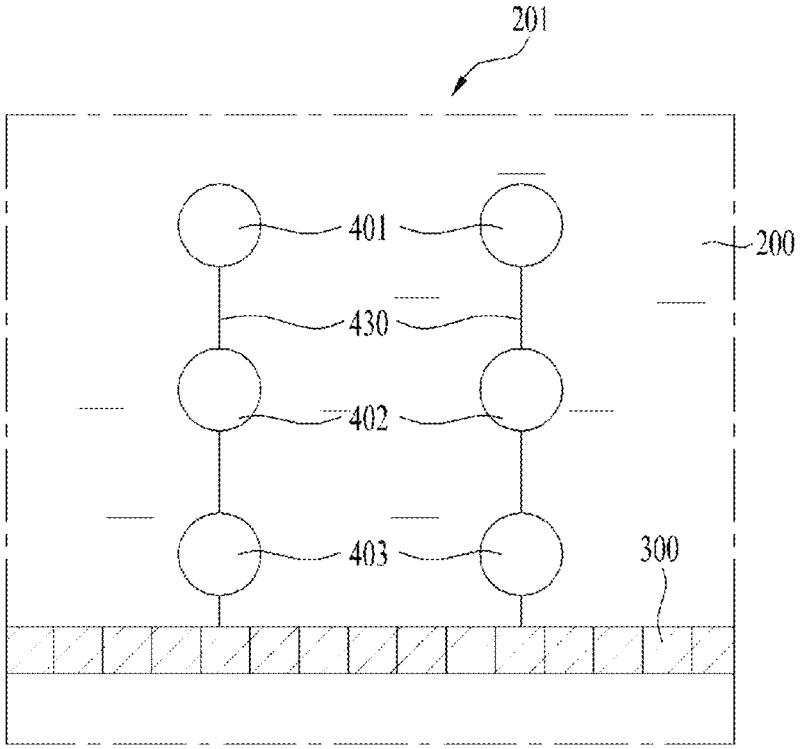

[Fig. 14a]
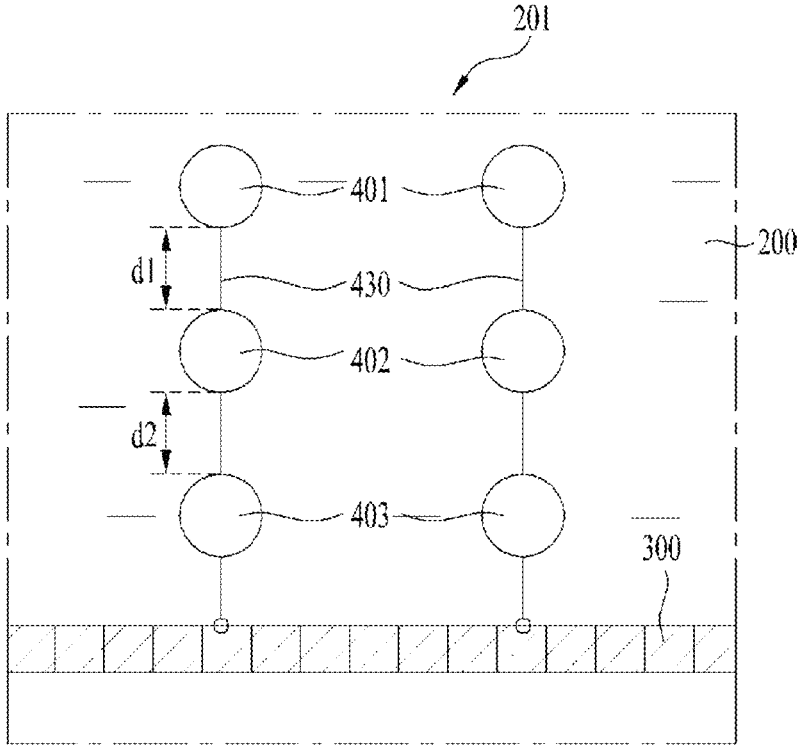

[Fig. 14b]
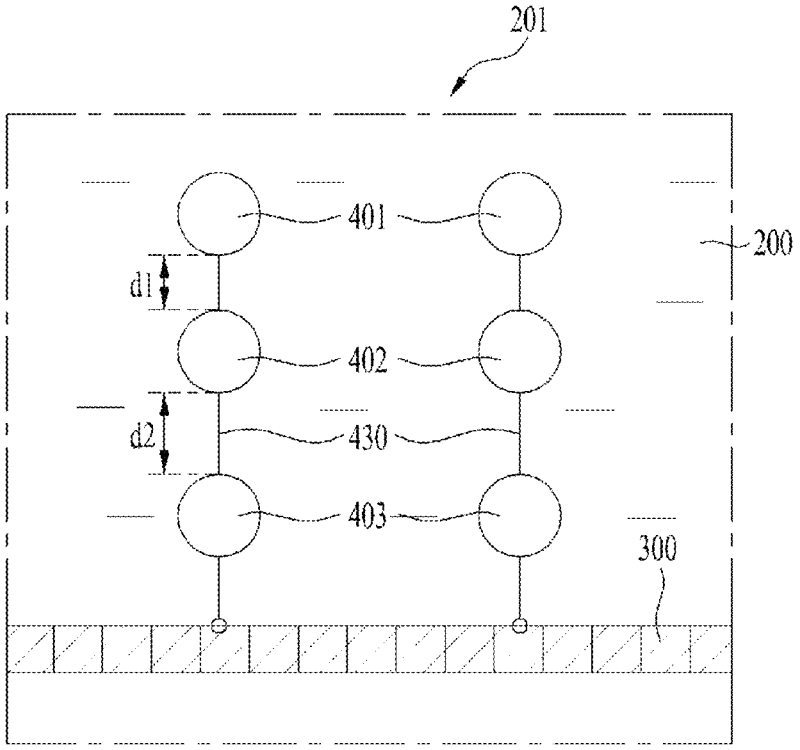

[Fig. 15a]
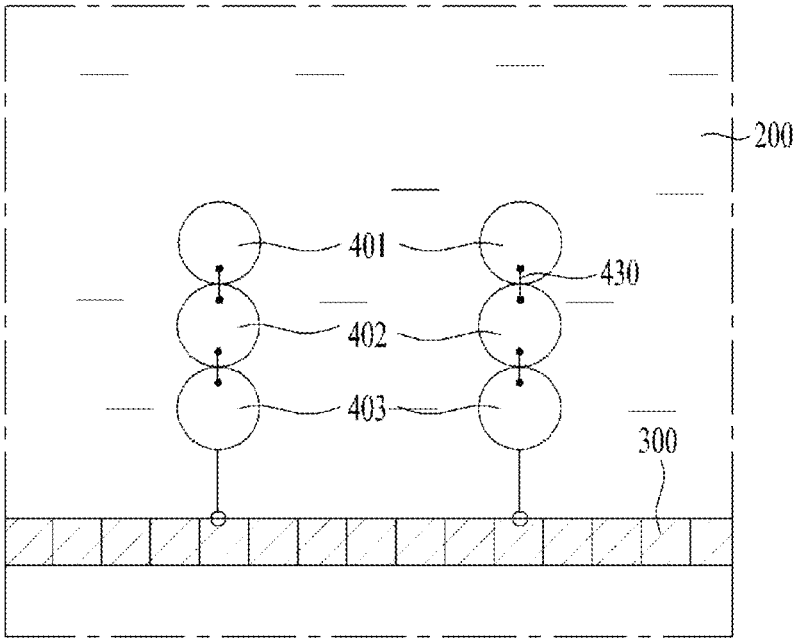
[Fig. 15b]
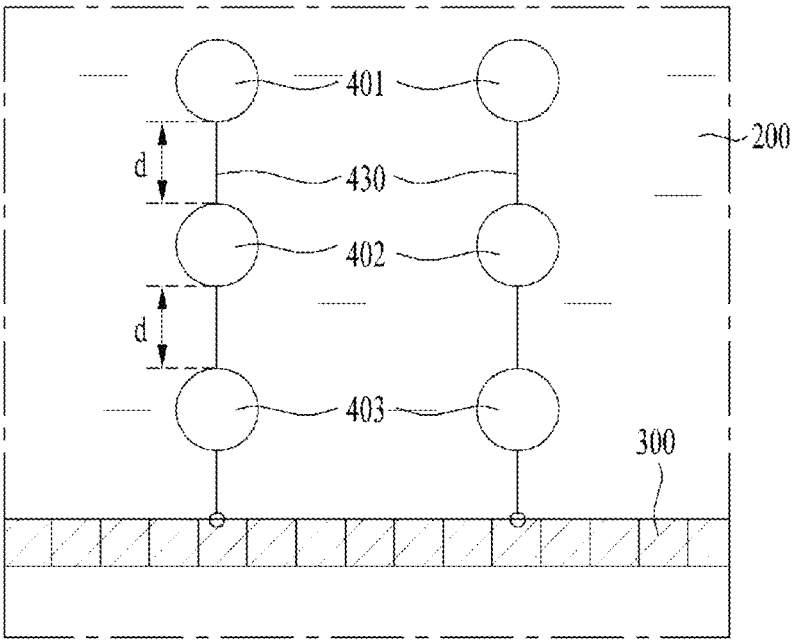

[Fig. 16a]
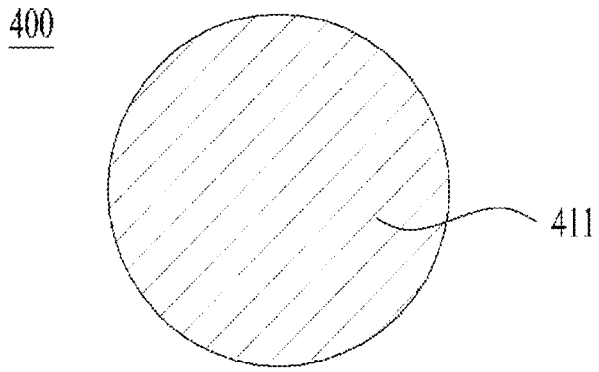
[Fig. 16b]
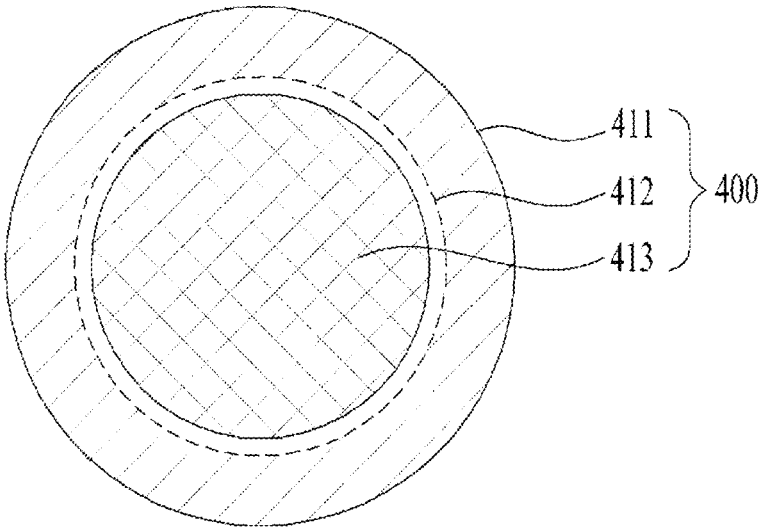

[Fig. 16c]
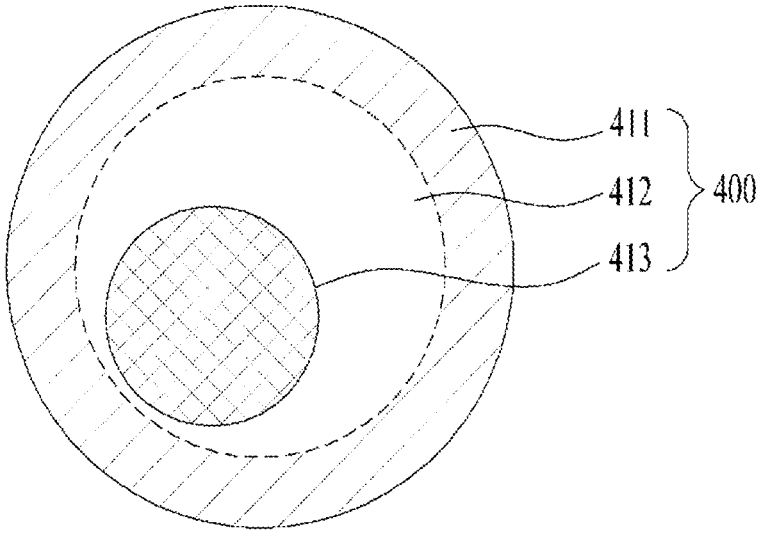
[Fig. 16d]
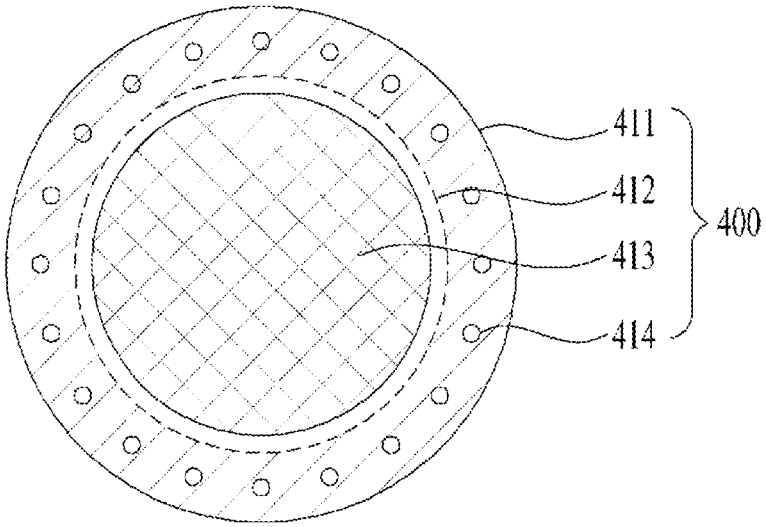

[Fig. 16e]
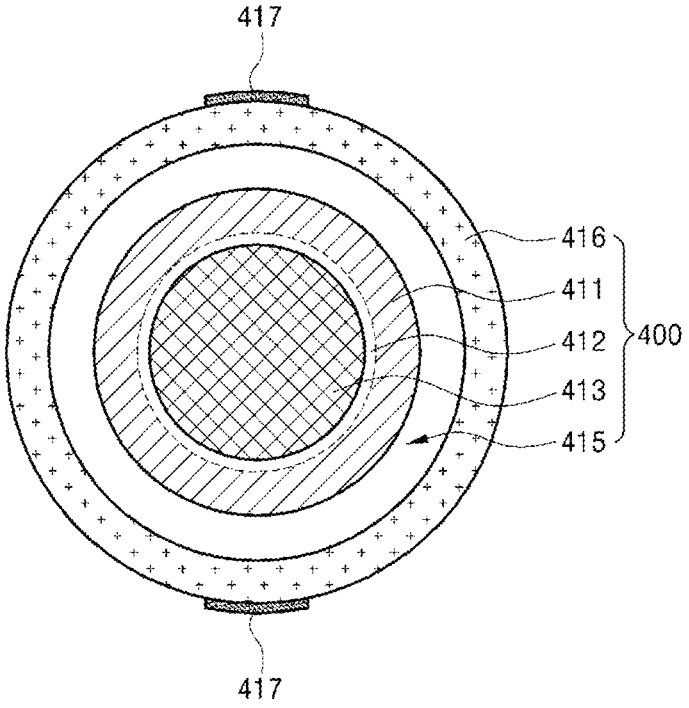

[Fig. 16f]
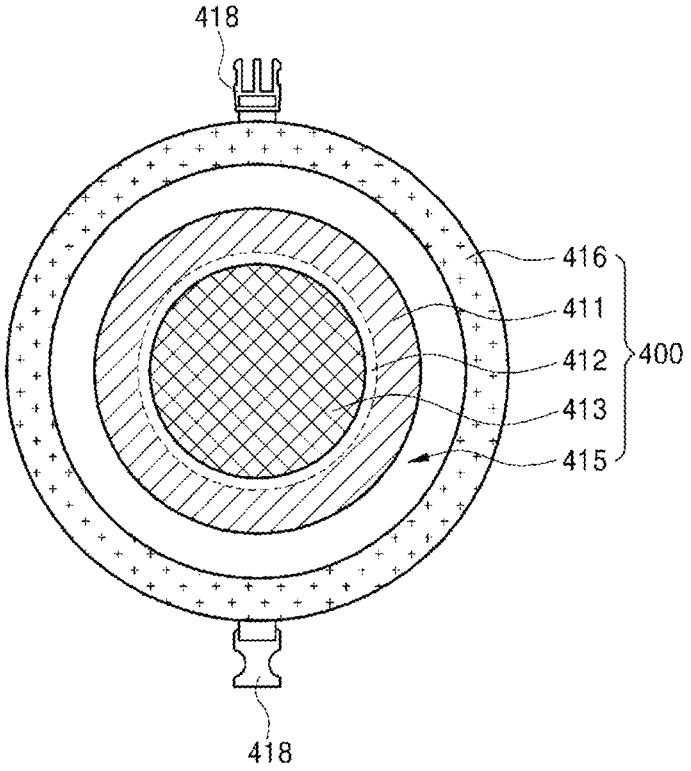

[Fig. 16g]
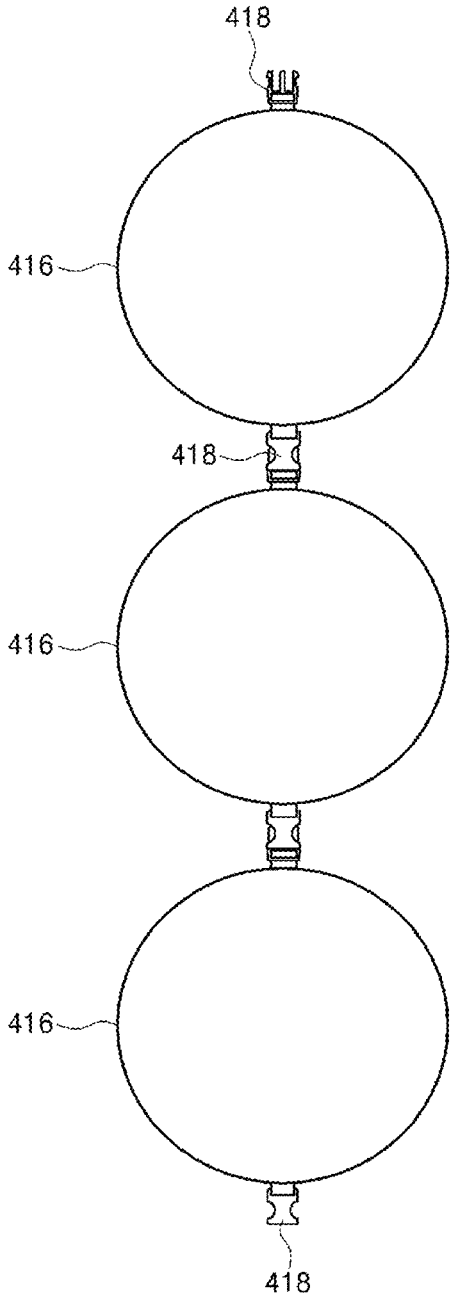

[Fig. 16h]
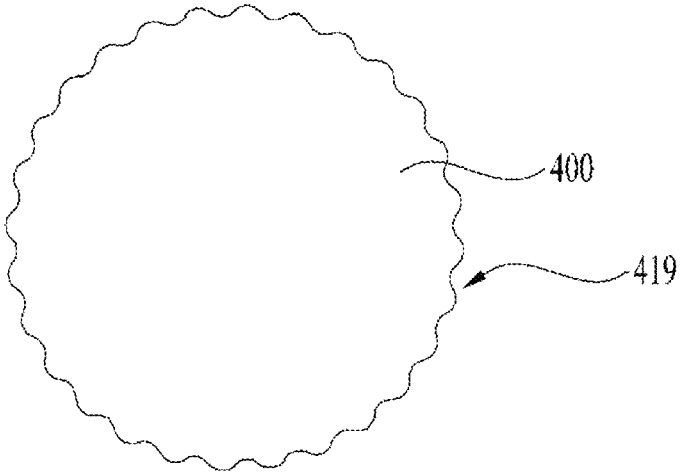

[Fig. 17a]
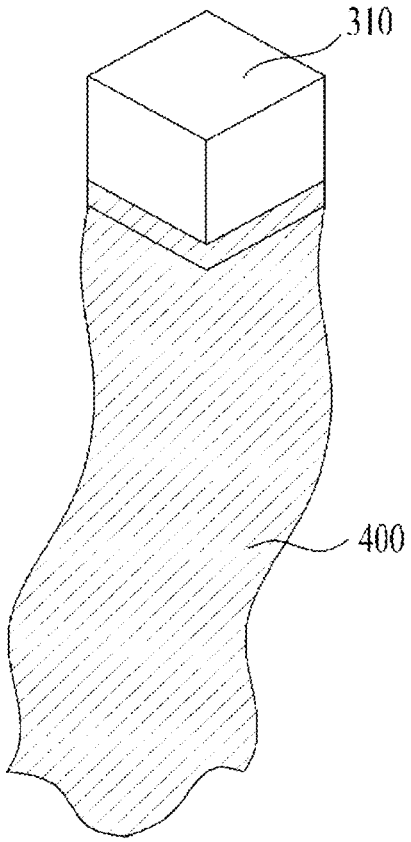

[Fig. 17b]
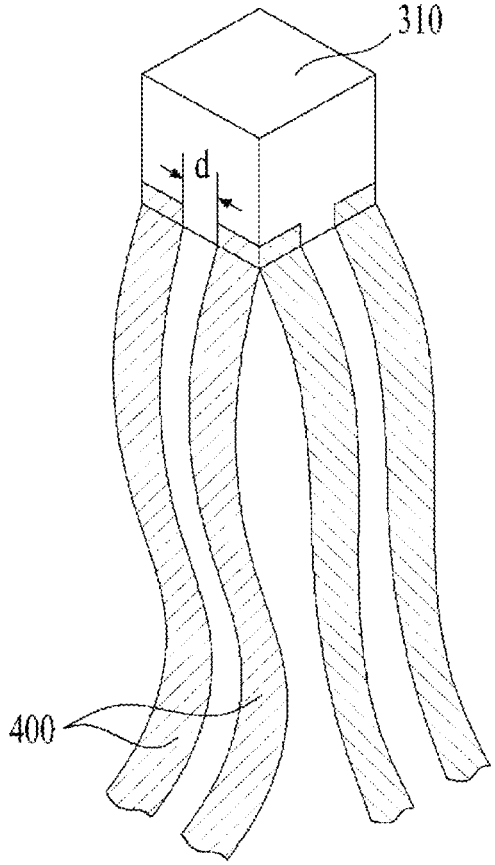

[Fig. 17c]
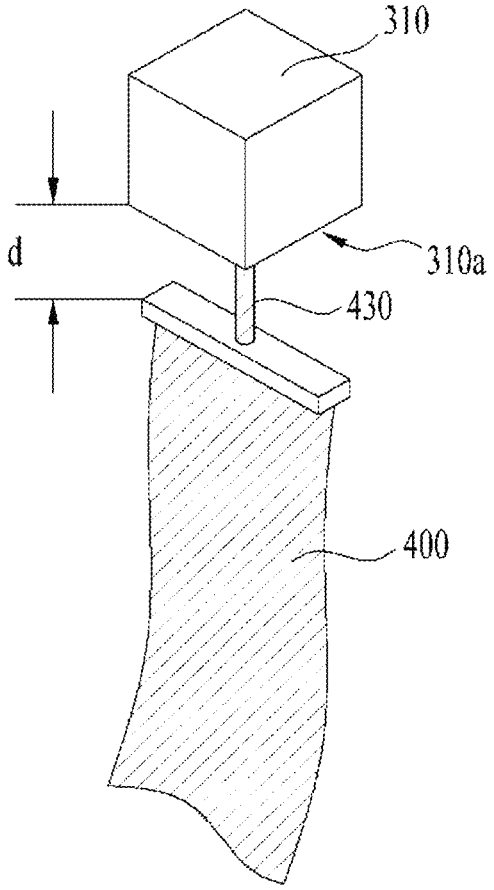

[Fig. 17d]
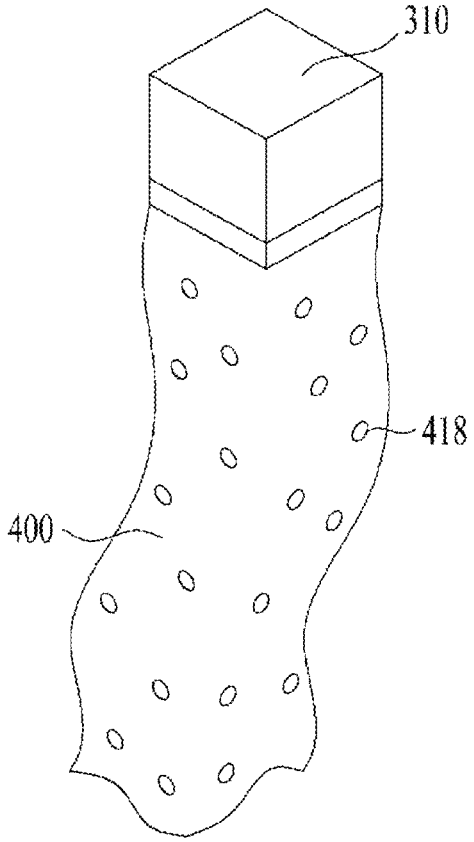

[Fig. 18a]
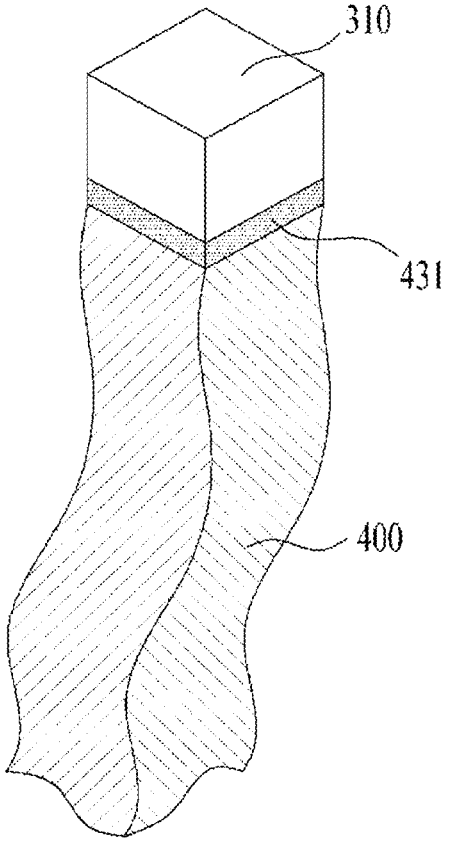

[Fig. 18b]
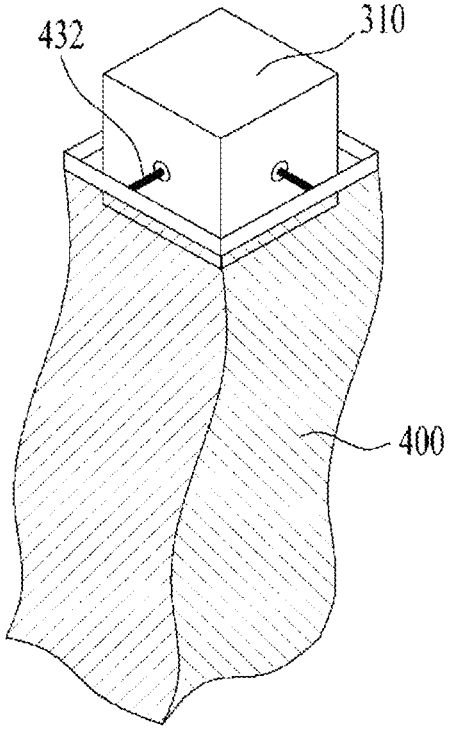

[Fig. 18c]
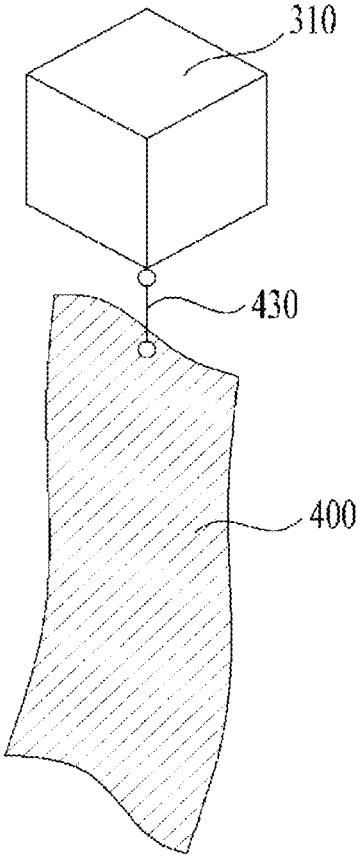

[Fig. 19a]
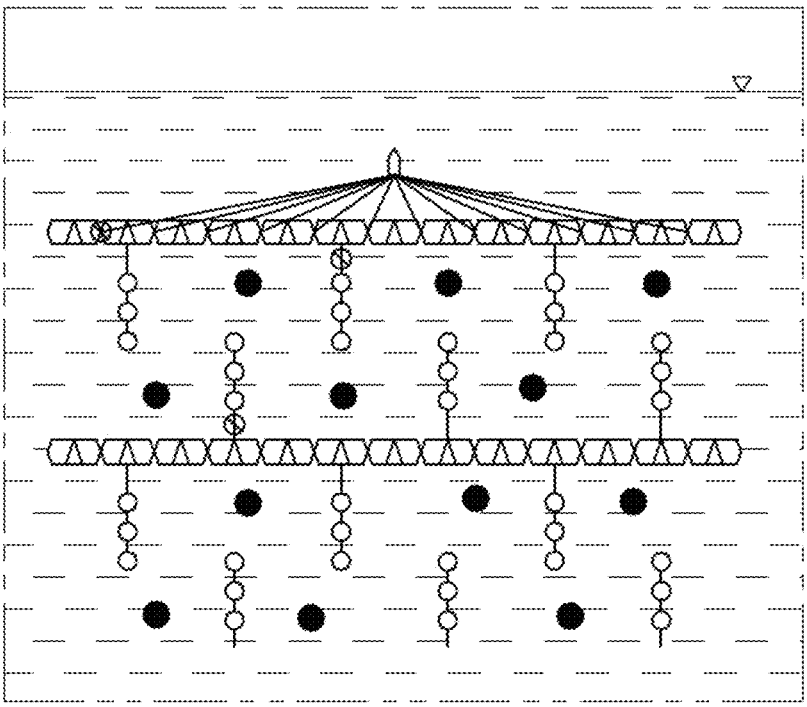
| | Sensor List |
|---|---|
| △ | Acceleration Sensor(510) |
| ● | Inertia Sensor(520) |
| ◇ | Vibration Sensor(530) |
| ☆ | Anemometer(540) |
| ✦ | Temperature Sensor(550) |
| ▯ | Pressure Sensor(560) |
| ⊘ | Shape Sensor(570) |
| ⬯ | Strain Sensor(580) |
| ⬠ | LOAD Cell(590) |

[Fig. 19b]
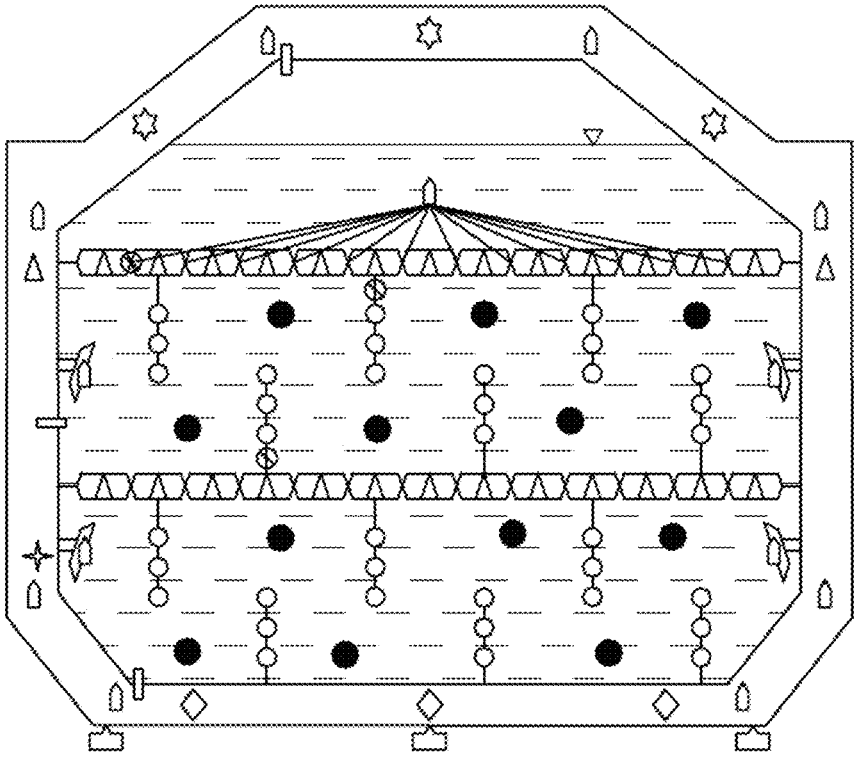
| | Sensor List |
|---|---|
| △ | Acceleration Sensor(510) |
| ● | Inertia Sensor(520) |
| ◇ | Vibration Sensor(530) |
| ☆ | Anemometer(540) |
| ✦ | Temperature Sensor(550) |
| ▯ | Pressure Sensor(560) |
| ⊘ | Shape Sensor(570) |
| ⬯ | Strain Sensor(580) |
| ⬠ | LOAD Cell(590) |

[Fig. 20a]
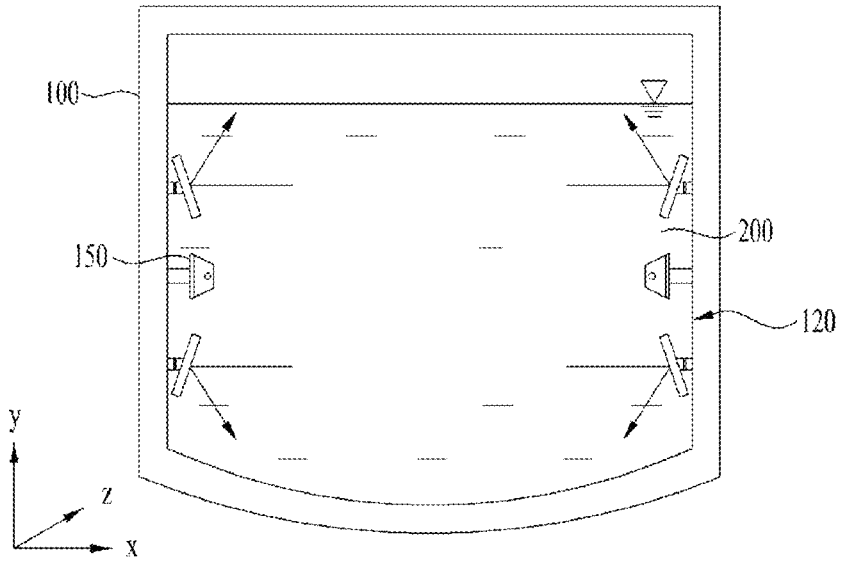
[Fig. 20b]
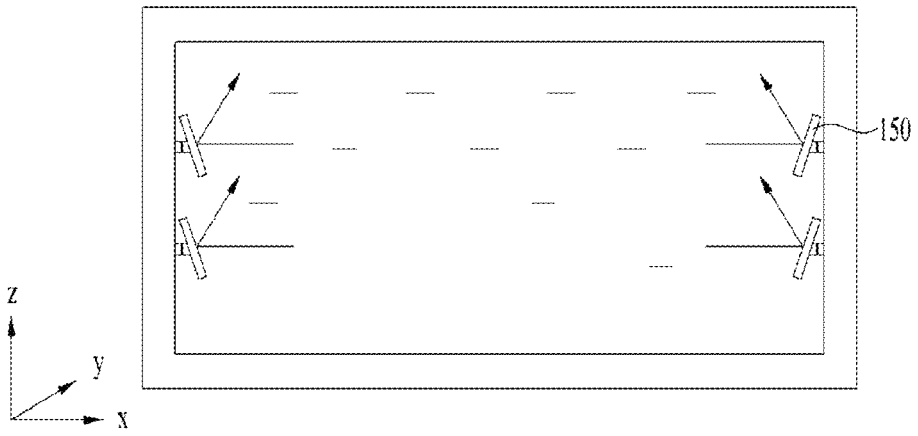

[Fig. 21a]
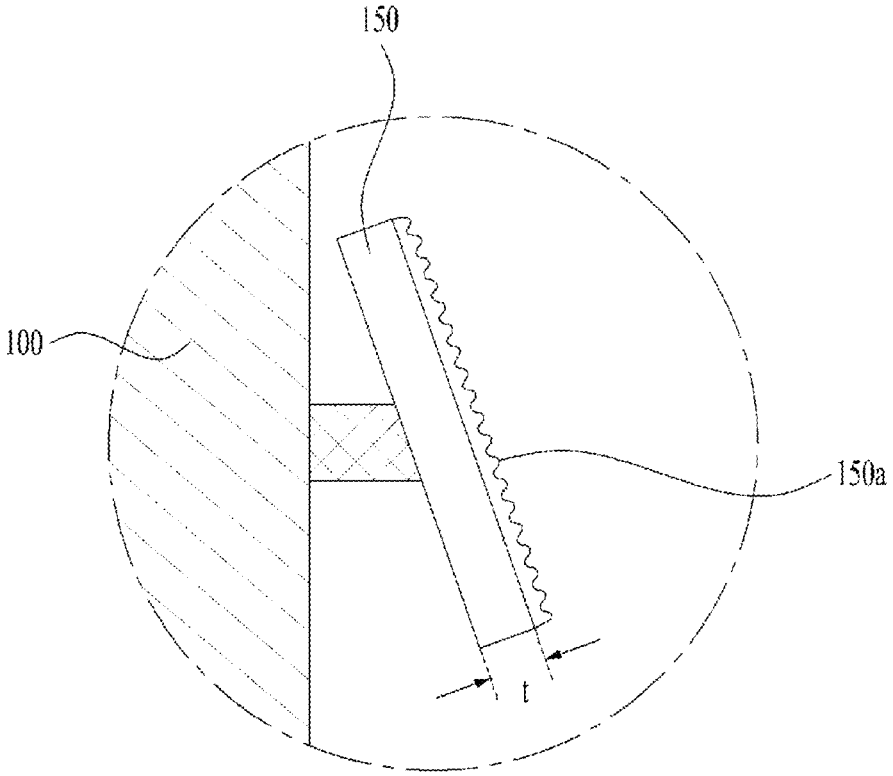

[Fig. 21b]
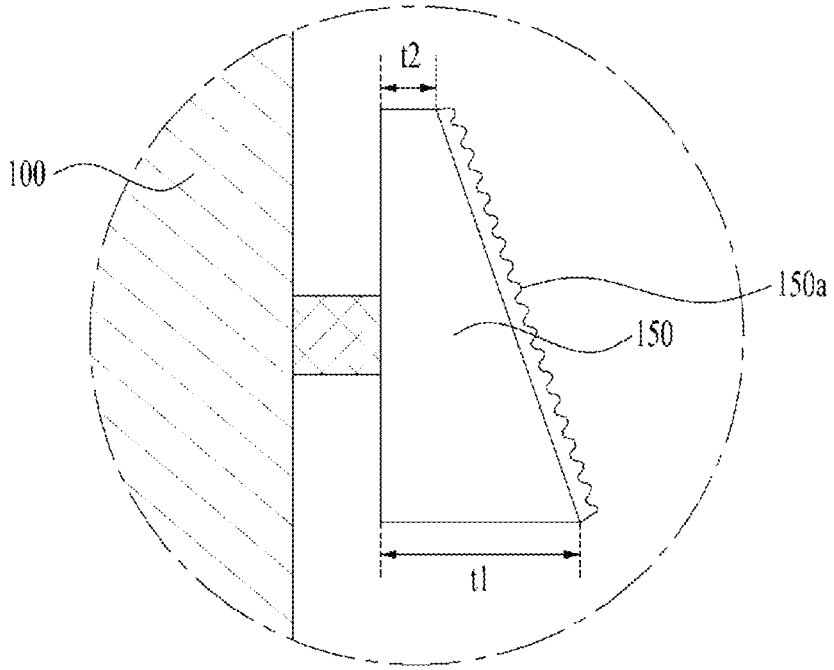

[Fig. 22]
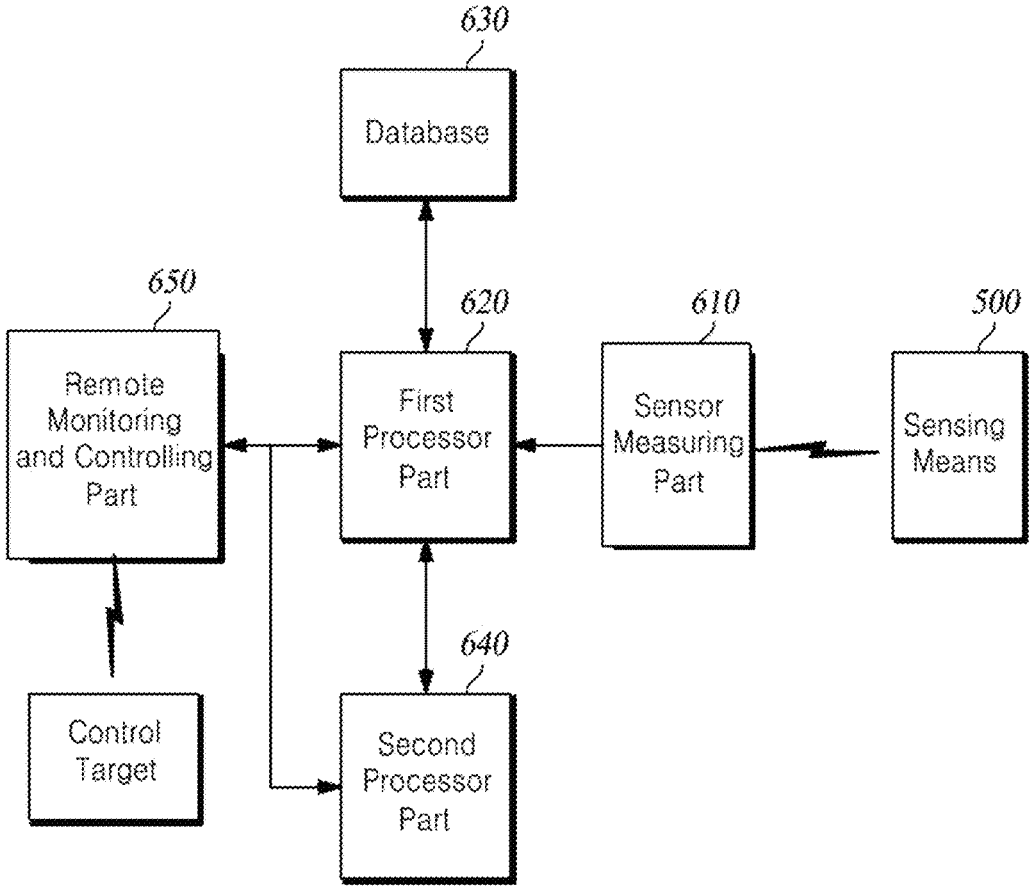

[Fig. 23]
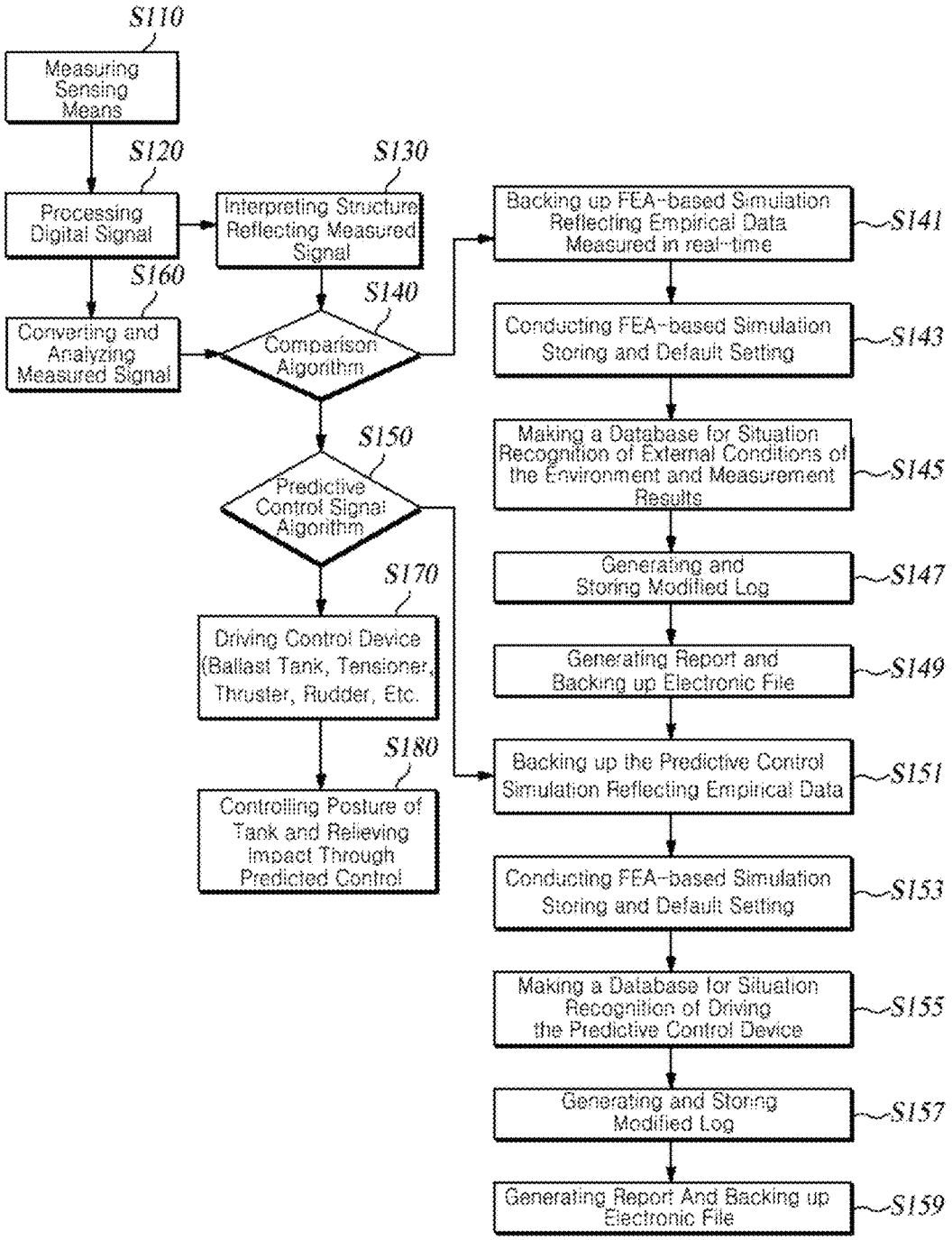

[Fig. 24a]
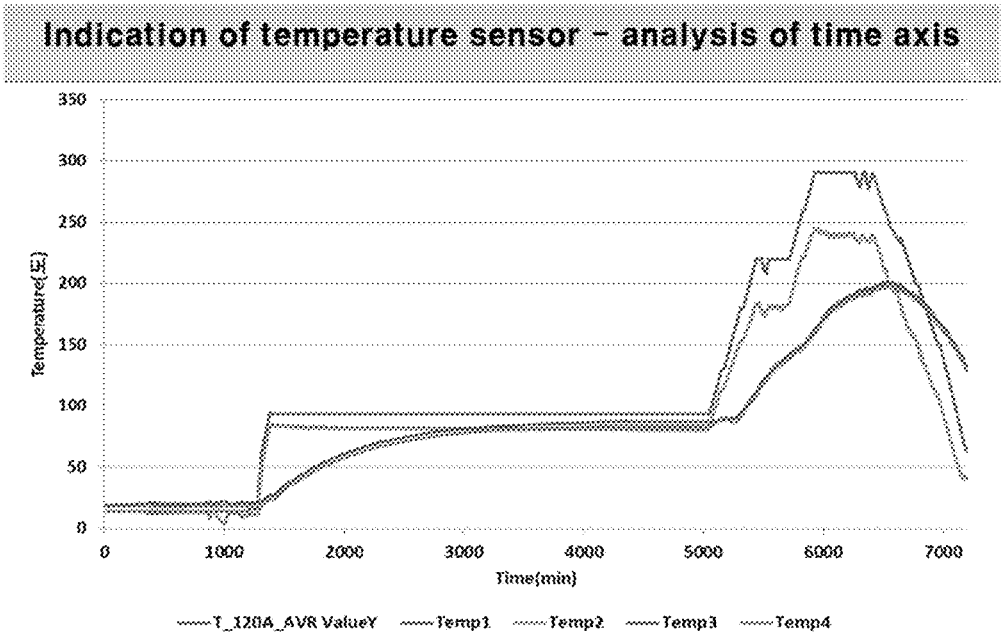
[Fig, 24b]
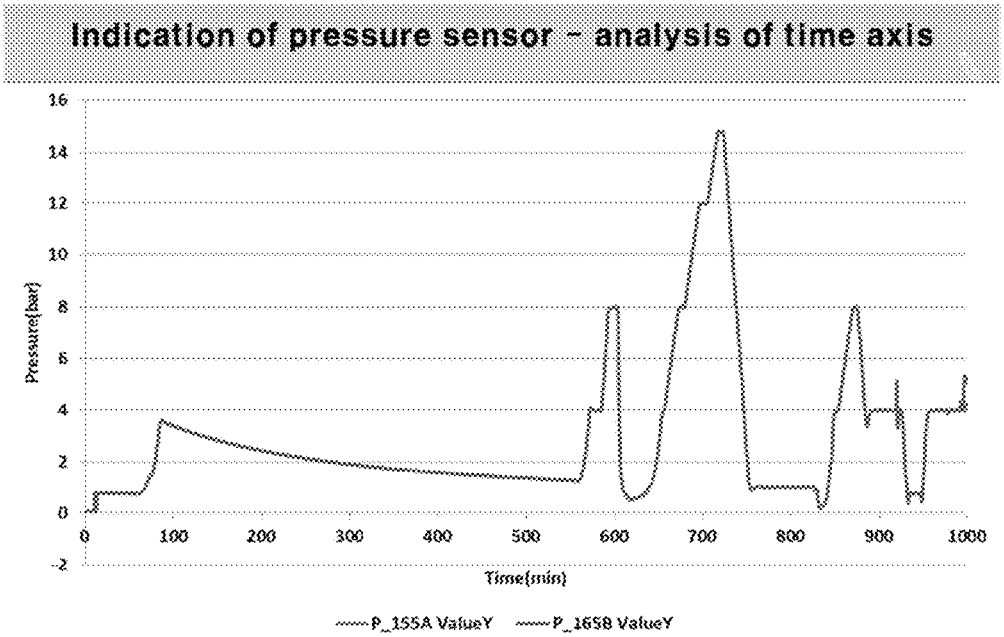

[Fig. 24c]
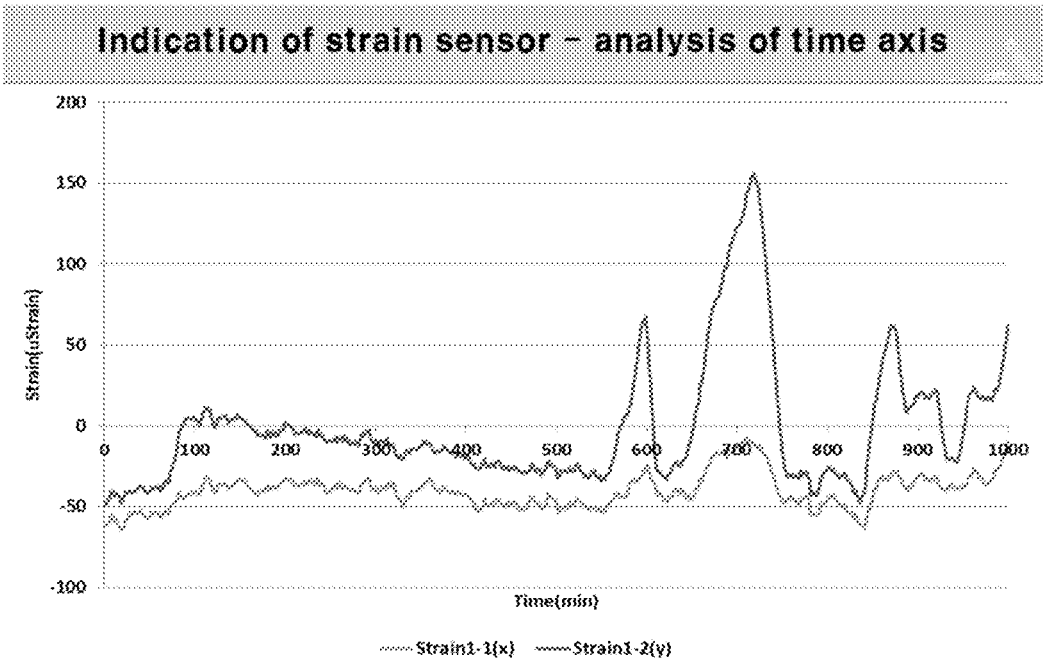

[Fig. 24d]
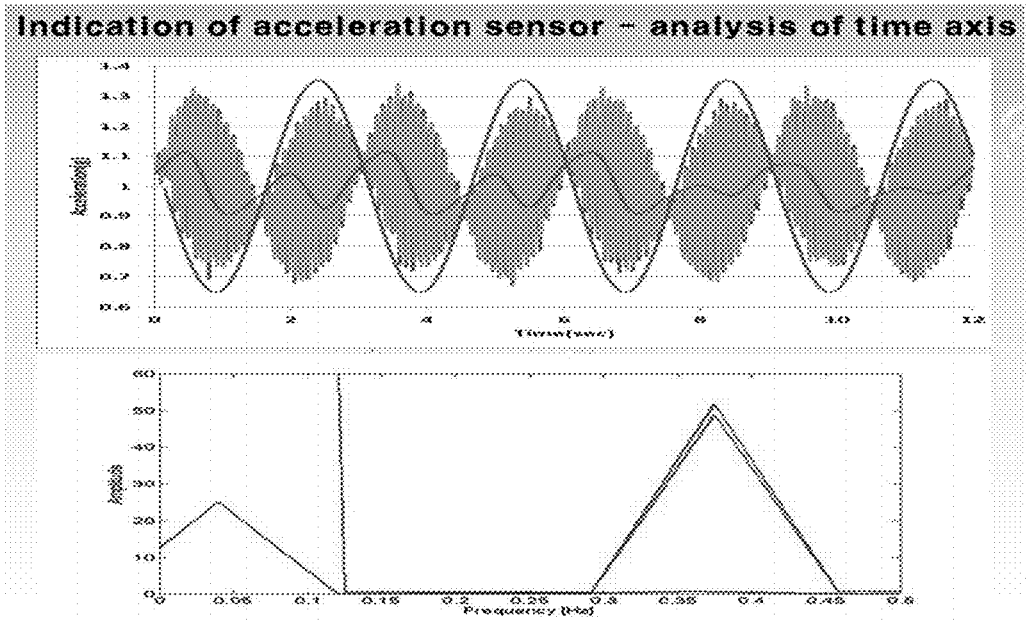

[Fig. 24e]
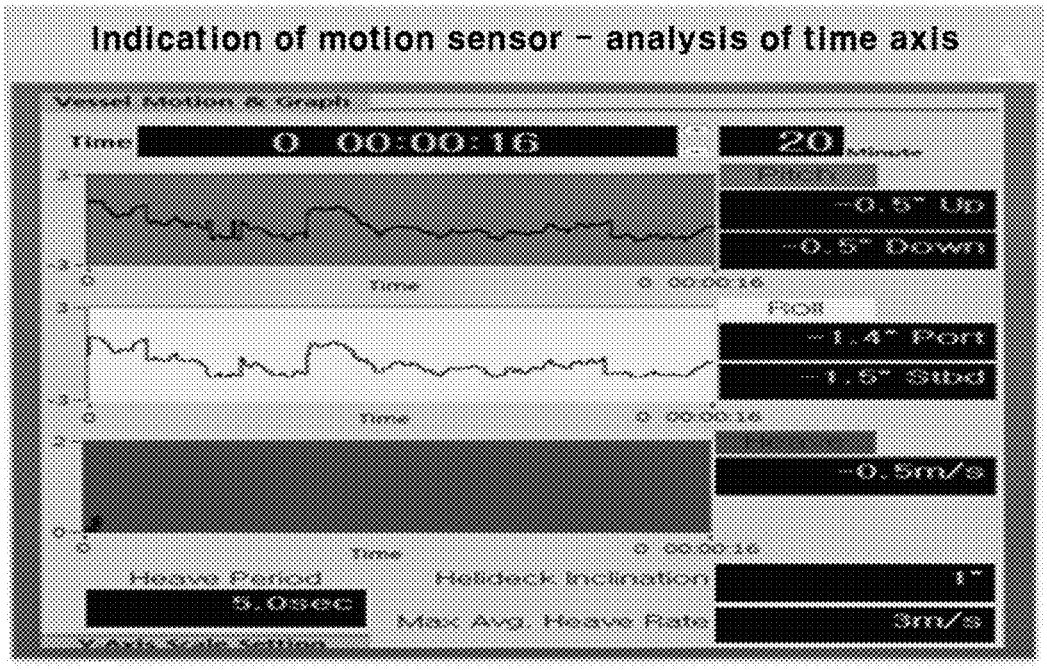

SYSTEM FOR MONITORING OR CONTROLLING IMPACT LOAD RESULTING FROM FLUID UNDER INTERNAL/EXTERNAL FORCE IN SPECIFIC ENVIRONMENT

CROSS-REFERENCE TO RELATED APPLICATIONS

This is a continuation application of International Application No. PCT/KR2015/002148 filed on Mar. 5, 2015, which claims priority to Korean Application No. 10-2014-0026086 filed on Mar. 5, 2014. The applications are incorporated herein by reference.

TECHNICAL FIELD

The present invention relates to a system for controlling an impact load resulting from a fluid under an internal/external force in a specific environment interworking with environmental external monitoring. More specifically, the present invention relates to a system for controlling an impact load resulting from a fluid under an internal/external force in a specific environment applicable to fluid existing in the river, lake, sea and transportation devices, etc., which can minimize impact load of a fluid under internal/external force including sloshing, slamming, and ice collision, in consideration of the environmental external force and movement of maritime structure or transportation devices.

BACKGROUND ART

In general, in order to transport fluid cargos, various forms of vessels are manufactured.

For example, in order to transport fluid or fuel such as LNG, LPG, hydrate, crude oil, etc., transportation devices are manufactured reflecting the characteristic of each transportation material and effect of internal/external force in the environment. In this regard, transportation devices or fuel storage tanks of a particular shape are applied so as to seal or keep the transportation material at extremely low temperature, low temperature or high temperature, etc. in the transportation device.

When manufacturing such transportation devices or fuel storage tanks, one of the important load conditions is sloshing.

Here, sloshing means a behavior of the fluid causing strong impact to an inner wall of a transportation device while radically shaking the fluid having a free surface by continuously receiving kinetic energy due to the movement of transportation devices such as a hull. The sloshing problem needs to be considered from an initial stage of manufacturing a maritime structure or transportation device.

Thus, the maritime structure or transportation device is designed to minimize the sloshing by a fluid while sufficiently standing the expected sloshing load.

Also, during this process, in order to avoid sloshing load which is difficult to stand structurally, ship owners had to accept conditional shipping conditions limiting the cargo load.

Nevertheless, due to the uncertainty of the sloshing load, there are many problems relating to damage on unexpected cargo holds.

In order to solve the above, Korean Patent No. 1043622 discloses a device for inhibiting sloshing including a plurality of buoyant bodies floating on the surface of liquid cargo.

However, since the conventional technologies cannot block sloshing occurring inside liquid cargo, the sloshing load occurring on the surface of the liquid cargo is very irregular, and the sloshing load is too big, and thus there is a limitation in blocking sloshing.

Thus, a system for controlling an impact load resulting from a fluid under an internal/external force in a specific environment applicable to fluid existing in the river, sea or transportation means, which can minimize the impact load resulting from a fluid under an internal/external force including sloshing, slamming, or ice collision, in consideration of the effect of internal/external force in a specific environment such as inside a transportation device or natural environment, is required.

SUMMARY OF INVENTION

The task of an embodiment of the prevent invention is to provide a system for controlling an impact load resulting from a fluid under an internal/external force in a specific environment, which can efficiently attenuate impact load including sloshing, slamming, and ice collision against fluid under an internal/external force while detecting impact fluid including sloshing, slamming, and ice collision against fluid under an internal/external force in a specific environment such as natural environments such as river, lake, sea, etc. or sealed transportation means such as a container, fuel tank, etc.

Another task of the present invention is to provide a system for controlling an impact load resulting from a fluid under an internal/external force in a specific environment, which allows a simple and quick process of the work of connecting a plurality of mat members and maintenance thereof through a detachable member fixed to the cover of the mat member.

The system for controlling an impact load resulting from a fluid under an internal/external force in a specific environment according to an embodiment of the present invention includes a floating means 300 arranged horizontally inside a predetermined amount of fluid 200 existing in an open space or in a space having a sealed interior; a position adjustment means 400 vertically connected to the floating means 300 and arranged in a preset position inside the fluid; a sensing means 500 selectively installed inside the fluid 200, on the floating means 300, on the position adjustment means 400, or on a structure positioned in the periphery to sense a physical change of at least one preset measurement object; and a control means 600 for predicting/monitoring and predicting/controlling fluid dynamics-related environment internal/external forces, hull stress, six-degree-of-freedom movements, and positions in connection with a transportation means 100 or a maritime structure, on which the floating means 300, the position adjustment means 400, and the sensing means 500 are installed, using the physical change value related to the measurement object transmitted from the sensing means 500.

According to a system for controlling an impact load resulting from a fluid under an internal/external force in a specific environment according to the present invention, the impact load and boil off gas (BOG) of the fluid can be minimized while efficiently sensing the impact load of various fluids including sloshing, slamming, ice collision, etc. by arranging the mat member inside the fluid varying the specific gravity of the floating body installed vertical to the mat member.

Also, the present invention can allow a simple and quick process of the work of connecting a plurality of mat members and maintenance thereof through a detachable member fixed to the cover of a mat member, and thus has an effect of improving the convenience in workability as compared to the conventional method which fixed the mat member using a wire or rope.

BRIEF DESCRIPTION OF DRAWINGS

FIGS. 1A-1C are cross-sectional views illustrating a condition applying the system for controlling an impact load resulting from fluid under internal/external force in a specific environment according to a preferable embodiment of the present invention to natural environment such as rivers, lakes, and sea;

FIGS. 2A-2C are cross-sectional views illustrating a condition applying the system for controlling an impact load resulting from fluid under internal/external force in a specific environment according to a preferable embodiment of the present invention to a transportation means such as a container or a fuel storage tank;

FIGS. 3A-3C are cross-sectional views illustrating a position adjustment means applied to the system for controlling an impact load resulting from fluid under internal/external force in a specific environment according to a preferable embodiment of the present invention;

FIGS. 4A, 4B, 5, 6A, 6B, 7A, 7B and 7C are plan views illustrating an arrangement of a floating means applied to the system for controlling an impact load resulting from fluid under internal/external force in a specific environment according to a preferable embodiment of the present invention;

FIGS. 8, 9A, 9B, 10 11A, 11B, 11C and 12 are perspective views and cross-sectional views illustrating a mat member of a floating means applied to the system for controlling an impact load resulting from fluid under internal/external force in a specific environment according to a preferable embodiment of the present invention;

FIGS. 13A and 13B are cross-sectional views illustrating that a position adjustment means applied to the system for controlling an impact load resulting from fluid under internal/external force in a specific environment according to a preferable embodiment of the present invention is formed in various sizes;

FIGS. 14A and 14B are cross-sectional views illustrating intervals between the position adjustment means applied to the system for controlling an impact load resulting from fluid under internal/external force in a specific environment according to a preferable embodiment of the present invention;

FIGS. 15A and 15B are cross-sectional views illustrating a contact condition of position adjustment means applied to the system for controlling an impact load resulting from fluid under internal/external force in a specific environment according to a preferable embodiment of the present invention;

FIGS. 16A-16F are cross-sectional views illustrating an inner structure of a position adjustment means applied to the system for controlling an impact load resulting from fluid under internal/external force in a specific environment according to a preferable embodiment of the present invention;

FIG. 16G is a perspective view illustrating a plurality of position adjustment means according to a preferable embodiment of the present invention;

FIG. 16H is a perspective view illustrating a position adjustment means according to a preferable embodiment of the present invention;

FIGS. 17A-17D are perspective views illustrating a position adjustment means having a curtain shape applied to the system for controlling an impact load resulting from fluid under internal/external force in a specific environment according to a preferable embodiment of the present invention;

FIGS. 18A-18C are perspective views illustrating a condition of the connection between a position adjustment means having a curtain shape and a floating means applied to the system for controlling an impact load resulting from fluid under internal/external force in a specific environment according to a preferable embodiment of the present invention;

FIGS. 19A-19B are cross-sectional views illustrating an arrangement of a sensor sensing a movement of impact load of fluid applied to the system for controlling an impact load resulting from fluid under internal/external force in a specific environment according to a preferable embodiment of the present invention;

FIGS. 20A-20B are cross-sectional views illustrating a condition having a bumper plate installed in an inner wall of a transportation means when the system for controlling an impact load resulting from fluid under internal/external force in a specific environment according to a preferable embodiment of the present invention is installed in a transportation means;

FIGS. 21A-21B are side cross-sectional views illustrating a thickness of a bumper plate installed in an inner wall of a transportation means when the system for controlling an impact load resulting from fluid under internal/external force in a specific environment according to a preferable embodiment of the present invention is installed in a transportation means;

FIG. 22 is a block diagram of a control means 600 applied to the system for controlling an impact load resulting from fluid under internal/external force in a specific environment according to a preferable embodiment of the present invention;

FIG. 23 is a control flow chart for explaining a control operation of the system for controlling an impact load resulting from fluid under internal/external force in a specific environment according to a preferable embodiment of the present invention; and FIGS. 24A-24E are graphs illustrating measurement data sensed at a sensing means of the system for controlling an impact load resulting from fluid under internal/external force in a specific environment according to a preferable embodiment of the present invention.

BEST MODE FOR CARRYING OUT THE INVENTION

Hereinafter, the present invention will be described in detail with reference to the drawings.

In the following description, usage of suffixes such as "module" and "part" used for referring to elements is given merely to facilitate explanation of the present invention, and the "module" and "part" may be used interchangeably.

Further, hereinafter, exemplary embodiments of the present invention are described with reference to the accompanying drawings and contents disclosed therein, however, the present invention is not limited thereto or restricted thereby.

The terms used in this specification were selected to include current, widely-used, general terms, in consideration of the functions of the present invention. However, the terms may represent different meanings according to the intentions of the skilled person in the art or according to customary usage, the appearance of new technology, etc. In certain cases, a term may be one that was arbitrarily established by the applicant. In such cases, the meaning of the term will be defined in the relevant portion of the detailed description. As such, the terms used in the specification are not to be defined simply by the name of the terms but are to be defined based on the meanings of the terms as well as the overall description of the present invention.

FIGS. 1A-1C are cross-sectional views illustrating a condition applying a system for controlling an impact load resulting from fluid under internal/external force in a specific environment according to a preferable embodiment of the present invention to natural environment such as rivers, lakes, and sea. FIGS. 2A-2C are cross-sectional views illustrating a condition applying a system for controlling an impact load resulting from fluid under internal/external force in a specific environment according to a preferable embodiment of the present invention to a transportation means such as a container or a fuel storage tank. FIGS. 19A-19B are cross-sectional views illustrating an arrangement of a sensor sensing a movement of impact load of fluid applied to the system for controlling an impact load resulting from fluid under internal/external force in a specific environment according to a preferable embodiment of the present invention.

As shown in FIGS. 1A-1C, 2A-2C, and 19A-19B, the system for controlling an impact load resulting from fluid under internal/external force in a specific environment includes a floating means 300 arranged horizontally inside a predetermined amount of fluid 200 existing in an open space or in a space having a sealed interior 110; a position adjustment means 400 vertically connected to the floating means 300 and arranged in a preset position inside the fluid; and a sensing means 500 selectively installed inside the fluid 200, on the floating means 300, on the position adjustment means 400, or on a structure positioned in the periphery to sense a physical change of at least one preset measurement object.

The system for sensing an impact load may be applied to a liquefied natural gas carrier (LNGC), a floating-LNG (F-LNG), a floating storage regasification unit (FSRU), an LNG fueled vessel (LNGFV), an LNG bunkering vessel (LNGBV), an LNG bunkering terminal (LNGBT), etc.

Also, the fluid 200 in a preferable embodiment of the present invention means a condition where raw materials in gas state, liquid state and ice state are mixed in an unspecified form. This may apply in the same manner to all cases where the fluid is in gas state and liquid state, or where fluid ice including gas or other particles is mixed.

FIGS. 3A-3C are cross-sectional views illustrating a position adjustment means applied to the system for controlling an impact load resulting from fluid under internal/external force in a specific environment according to a preferable embodiment of the present invention.

Referring to FIGS. 3A-3C, the position adjustment means 400 includes at least one of a first floating body 410 arranged at an upper part of the floating means 300 and a second floating body 420 arranged at a lower part of the floating means 300.

In this case, preferably, the first floating body 410 of the position adjustment means 400 is formed to have a specific gravity smaller than the fluid 200 and the floating means 300, thus having the highest buoyancy, the second floating body 420 of the position adjustment means 400 is formed to have a specific gravity greater than the fluid 200 and the floating means 300, thus having the smallest buoyancy, and the floating means 300 is formed to have a specific gravity greater than the fluid 200 and the first floating body 410 and smaller than the second floating body 420, thus having a buoyancy therebetween.

As shown in FIG. 3A, preferably, the first floating body 410 and the second floating body 420 of the position adjustment means 400 are formed of a floating member 420*a* formed of a phenol resin, a melamine resin, and a synthetic resin thereof, and the first floating body 410 is formed to have a specific gravity smaller than the second floating body 420.

Also, the floating member 420*a* may be formed of a plurality of minute holes in the external surface, or formed of an uneven pattern on the side surface in some cases.

In some cases, as shown in FIG. 3B, the first floating body 410 of the position adjustment means 400 may be formed of a floating member having a buoyant body, and the second floating body 420 of the position adjustment means 400 may be formed of a curtain member 420*b* having a curtain shape formed of a phenol resin, a melamine resin, and a synthetic resin thereof.

Here, the curtain member 420*b* may be formed of one single member arranged to surround along a side circumference of the floating means 300, and in some cases, the curtain member 420*b* may be formed of a plurality of members arranged to surround along a side circumference of the floating means 300.

Here, when there are a plurality of curtain members 420*b*, adjacent curtain members may be arranged at predetermined intervals.

Also, a surface of the curtain member 420*b* may be formed of a plurality of holes where the fluid may float around.

Also, the curtain member 420*b* may be fixed or locked to the floating means 300 using at least one of an adhesive and a locking member.

Alternatively, as shown in FIG. 3C, the first floating body 410 of the position adjustment means 400 may be a floating member having a buoyant body, and the second floating body 420 of the position adjustment means 400 may include both a curtain member 420*b* having a curtain shape and a floating member 420*a* having buoyancy.

That is, the second floating body 420 of the position adjustment means 400 may be configured to have a floating member 420*a* locked at an end of the curtain member 420*b* having a curtain shape.

FIGS. 4 to 7 are plan views illustrating an arrangement of a floating means applied to the system for controlling an impact load resulting from fluid under internal/external force in a specific environment according to a preferable embodiment of the present invention.

Referring to FIGS. 4A, 4B, 5, 6A, 6B, 7A, 7B and 7C, the floating means 300 is formed of a plurality of mat members 310 connected to one another using a wire or rope, and mat members 310 having a function of a buoyant body are arranged at predetermined intervals to have a predetermined empty space. Thus, when liquid in the fluid 200 and the mat member 310 are sprayed between mat members 310 by inertial motion during movement, evaporated fluid in an upper part of the mat member 310 is re-collected in liquid state. In this case, in order to increase the re-collection rate of liquid included in the fluid 200, preferably, a plurality of minute holes or an uneven pattern is formed in the upper external surface and the side surface of the mat member 310.

Here, the mat member 310 may be formed using specific materials such as a phenol resin, a melamine resin, and a synthetic resin thereof.

As such, as shown in FIG. 4A, the floating means 300 formed of a plurality of mat members 310 connected to one another may include a first mat member 311 arranged in an odd number of columns and a second mat member 312 arranged in an even number of columns. In this regard, the first mat member 311 and the second mat member 312 are arranged crisscross each other.

Here, the first mat member 311 and the second mat member 312 may be formed in different shapes or in the same shape.

In some cases, adjacent first mat members 311 may be formed in different shapes or in the same shape, and adjacent second mat members 312 may be formed in different shapes or in the same shape.

For example, as shown in FIG. 5, the floating means 300 may include a first mat member 311 arranged in an odd number of columns and a second mat member 312 arranged in an even number of columns. In this regard, the first mat member 311 and the second mat member 312 are arranged crisscross each other.

Here, the first mat member 311 and the second mat member 312 may have the same shape.

As another example, as shown in FIG. 6A, the floating means 300 may include a first mat member 311 arranged in an odd number of columns and a second mat member 312 arranged in an even number of columns. In this regard, the first mat member 311 and the second mat member 312 are arranged crisscross each other.

Here, the first mat member 311 and the second mat member 312 may have different shapes.

As another example, as shown in FIG. 6B, the floating means 300 may include a first mat member 311 arranged in an odd number of columns and a second mat member 312 arranged in an even number of columns, and a first mat member 311 and a second mat member 312 may be arranged parallel to each other to form a lattice structure. In this case, the first mat member 311 and the second mat member 312 may have the same shape.

As shown in FIG. 6A, according to a preferable embodiment of the present invention, it is possible to apply a strain sensor measuring the shape or the extension or contraction of at least one axis when a 3-axis acceleration sensor is installed inside the mat member 310. Here, as shown in FIGS. 7A-7C, identification marks 317 and 319 to be identified by imaging device or laser are formed or attached to an upper surface of each mat member 310, so as to allow the control means 600 to measure and diagnose the position and six-degree-of-freedom movement of each mat member 310, thereby enabling optimized measurement and control of the impact load according to the present invention.

Here, as shown in FIG. 7B, preferably, the identification marks 317 and 319 use circular or quadrangular identification marks indicating quadrants, so as to distinguish rotating angles.

FIGS. 8, 9A, 9B, 10 11A, 11B, 11C and 12 are perspective views and cross-sectional views illustrating a mat member of a floating means applied to the system for controlling an impact load resulting from fluid under internal/external force in a specific environment according to a preferable embodiment of the present invention.

Referring to FIGS. 8, 9A, 9B, 10 11A, 11B, 11C and 12, the floating means 300 is formed of a plurality of mat members 310 connected to one another, and the mat members 310 are arranged at predetermined intervals to have a predetermined empty space.

As shown in FIG. 8, each mat member 310 of the floating means 300 may be formed only of a body part 301 playing the role of a buoyant body.

Here, the body part 301 may be made of a material having a predetermined specific gravity, and for example, aluminum or aluminum alloy may be used.

Next, as shown in FIGS. 9A and 9B, each mat member 310 of the floating means 300 includes a body part 301 having a closed space 303 in the center of an inner portion, and a buoyant body 305 arranged in the closed space 303 of the body part 301.

Here, as shown in FIG. 9A, the buoyant body 305 may take up an entire area of the closed space 303, and in some cases, as shown in FIG. 9B, the buoyant body 305 may take up only a part of the area of the closed space 303 and leave a space for controlling the position so that the floating means 300 may float at a predetermined depth.

In this case, the body part 301 may be formed using a foam member, and the buoyant body 305 may use aluminum or aluminum alloy having a predetermined specific gravity.

Next, as shown in FIG. 10, a plurality of minute holes 306 are formed in the external surface of the body part 301 of each mat member 310, and these minute holes 306 may minimize the sloshing of the fluid by increasing the specific surface area.

Next, as shown in FIG. 11A, each mat member 310 of the floating means 300 includes a body part 301 having a closed space 303 in the center of an inner portion, a buoyant body 305 arranged in the closed space 303 of the body part 301, and a cover 308 surrounding an external surface of the body part 301 and having at least one locking member 307*a* of a velcro tape type fixed to the external surface at predetermined intervals.

Also, as shown in FIG. 11B, instead of the locking member 307*a* of a velcro tape type, a locking member 307*b* of a hook type may be used.

Thus, as shown in FIG. 11C, when a plurality of mat members 310 are arranged connectedly extending horizontally, without having to fix or connect neighboring body parts 301 or buoyant bodies 305 using a wire or rope, the plurality of mat members 310 may be connected quickly and easily using locking members 307 such as a velcro tape, a hook, etc.

Meanwhile, as shown in FIGS. 11A-11C, by sealing the outside of the mat member 310 including a body part 301 and a buoyant body 305 once again, it is possible to continuously provide the unique function of attenuating the impact load resulting from the fluid while extending the body part 301 and the buoyant body 305 horizontally.

Meanwhile, preferably, a predetermined space 309 is formed between the body part 301 and the cover 308, and the position of the space 309 may be controlled so that the floating means 300 floats at a predetermined depth.

Also, as shown in FIG. 12, each mat member 310 of the floating means 300 may form an uneven pattern 307 at the side surface of the body part 301, and such uneven pattern 307 may be arranged irregularly, thereby minimizing the sloshing of the fluid.

FIGS. 13A-13B are cross-sectional views illustrating that a position adjustment means applied to the system for controlling an impact load resulting from fluid under internal/external force in a specific environment according to a preferable embodiment of the present invention is formed in various sizes.

Referring to FIGS. 13A and 13B, the position adjustment means 400 is connected to the floating means 300, so as to be arranged in at least one direction among the upper direction and lower direction of the floating means 300.

Here, the position adjustment means 400 arranged in the lower direction of the floating means 300 may be arranged at a predetermined interval from the bottom surface of the transportation means. In this case, the position adjustment means 400 may have a specific gravity greater than the fluid 200.

Also, the position adjustment means 400 arranged in the upper direction of the floating means 300 may be arranged at a predetermined interval from the surface of the fluid 200. In this case, the position adjustment means 400 may have a specific gravity smaller than the fluid 200.

When there are a plurality of position adjustment means 400, the plurality of position adjustment means may be connected to one another by a connecting member 430.

For example, with regard to the position adjustment means 400, when a first floating member 401, a second floating member 402, and a third floating member 403 are arranged in order in a downward direction from the surface 201 of the fluid 200, the first floating member 401, the second floating member 402, and the third floating member 403 are formed to have different specific gravity.

For example, the first floating member 401 has the smallest specific gravity, the third floating member 403 has the greatest specific gravity, and the second floating member 402 is formed to have a specific gravity greater than the first floating member 401 and smaller than the third floating member 403.

In some cases, when there are a plurality of position adjustment means, as the position adjustment means gets farther from the floating means 300, the specific gravity of the position adjustment means 400 may get smaller gradually.

Also, as shown in FIG. 13A, with regard to the position adjustment means 400, when the first floating member 401, the second floating member 402, and the third floating member 403 are arranged in order in a downward direction from the surface 201 of the fluid 200, the first floating member 401, the second floating member 402, and the third floating member 403 may have different sizes.

For example, the first floating member 401 may be the largest, the third floating member 403 may be the smallest, and the second floating member 402 may be smaller than the first floating member 401 and larger than the third floating member 403.

For example, the first floating inlet 103 member 401 may be larger or smaller than the second floating member 402.

In some cases, when there are a plurality of position adjustment means 400, as the position adjustment means gets farther from the floating means 300, the size of the position adjustment means 400 may get smaller or larger gradually.

In some cases, as shown in FIG. 13B, the first floating member 401, the second floating member 402, and the third floating member 403 may have the same size.

As such, the position adjustment means 400 may be produced in various shapes according to their size and specific gravity.

FIGS. 14A-14B are cross-sectional views illustrating intervals between the position adjustment means applied to the system for controlling an impact load resulting from fluid under internal/external force in a specific environment according to a preferable embodiment of the present invention.

Referring to FIGS. 14A-14B, the position adjustment means 400 may be connected to the floating means 300 to be arranged in at least one direction of the upper direction and lower direction of the floating means 300.

Here, when there are a plurality of position adjustment means 400, the plurality of position adjustment means 400 are connected by a locking member 430.

For example, as shown in FIG. 14A, with regard to the position adjustment means 400, when the first floating member 401, the second floating member 402, and the third floating member 403 are arranged in order in a downward direction from the surface 201 of the fluid 200, interval d1 between the first floating member 401 and the second floating member 402, and interval d2 between the second floating member 402 and the third floating member 403 may be the same.

In some cases, as shown in FIG. 14B, with regard to the position adjustment means 400, when the first floating member 401, the second floating member 402, and the third floating member 403 are arranged in order in a downward direction from the surface 201 of the fluid 200, interval d1 between the first floating member 401 and the second floating member 402, and interval d2 between the second floating member 402 and the third floating member 403 may be different.

For example, interval d1 between the first floating member 401 and the second floating member 402 may be smaller or larger than interval d2 between the second floating member 402 and the third floating member 403.

In this regard, as the area where sloshing occurs varies according to the depth of the fluid 200, sloshing may be minimized by arranging the position adjustment means 400 only in an area with high sloshing according to the depth of the fluid by controlling the interval between the position adjustment means 400.

FIGS. 15A-15B are cross-sectional views illustrating a contact condition of position adjustment means applied to the system for controlling an impact load resulting from fluid under internal/external force in a specific environment according to a preferable embodiment of the present invention.

Referring to FIGS. 15A-15B, the position adjustment means 400 may be connected to the floating means 300 to be arranged in at least one direction of the upper direction and lower direction of the floating means 300.

Here, when there are a plurality of position adjustment means 400, the plurality of position adjustment means 400 may be connected by a locking member 430.

For example, as shown in FIG. 15A, with regard to the position adjustment means 400, when the first floating member 401, the second floating member 402, and the third floating member 403 are arranged in order in a downward direction from the surface 201 of the fluid 200, the first floating member 401 and the second floating member 402 may be arranged to be in contact with each other, and the second floating member 402 and the third floating member 403 may be arranged to be in contact with each other.

In this case, sloshing may be minimized by arranging the position adjustment means 400 to be in contact with each other to be arranged in groups having a large area when sloshing occurring in the fluid occurs over a broad area in the depth direction.

In this case, as shown in FIG. 15B, with regard to the position adjustment means 400, when the first floating member 401, the second floating member 402, and the third floating member 403 are arranged in order in a downward direction from the surface 201 of the fluid 200, the first floating member 401 and the second floating member 402 may be arranged apart in a predetermined interval d, and the second floating member 402 and the third floating member 403 may be arranged apart in a predetermined interval d.

FIGS. 16A-16F are cross-sectional views illustrating an inner structure of a position adjustment means applied to the system for controlling an impact load resulting from fluid under internal/external force in a specific environment according to a preferable embodiment of the present invention.

Referring to FIGS. 16A-16F, the position adjustment means 400 may be connected to the floating means 300 to be arranged in at least one direction of the upper direction and lower direction of the floating means 300.

As shown in FIG. 16A, the position adjustment means 400 may be configured only of a body part 411 made of materials such as aluminum or aluminum alloy to play the role of a buoyant body.

Next, as shown in FIGS. 16B-16C, the position adjustment means 400 may include a body part 411 having a closed space 412 in the center of an inner portion, and a buoyant body 413 arranged in the closed space 412 of the body part 411.

Here, as shown in FIG. 16B, the buoyant body 413 may take up the entire area of the closed space 412, and in some cases, as shown in FIG. 16C, the buoyant body 413 may take up only part of the area of the closed space 412 and leave a space for controlling the position so that the floating means 300 floats at a predetermined depth.

Here, the body part 411 may be a foam member, and the buoyant body 413 may be made of a material having a predetermined specific gravity such as aluminum or aluminum alloy.

Next, as shown in FIG. 16D, the position adjustment means 400 may be formed of a plurality of minute holes 414 in the external surface of the body part 411.

These minute holes 414 may minimize the sloshing of the fluid by increasing the specific gravity.

Next, as shown in FIG. 16E, the first floating body 410 or the second floating body 420 of the position adjustment means 400 includes a body part 411 having a closed space 412 in the center of an inner portion, a buoyant body 413 arranged in the closed space 412 of the body part 411, and a cover 416 surrounding an external surface of the body part 411 with an optional vacant space 415 defined there-between and having locking members 417 and 418 fixed to the upper surface and lower surface of the cover 416.

Here, as shown in FIG. 16E, the locking member may be used selected from a locking member 417 of a velcro tape type, or from a locking member 318 of a hook type as shown in FIG. 16F.

Thus, as shown in FIG. 16G, when a plurality of position adjustment means 400 are connectedly arranged horizontally, without having to fix or connect neighboring body parts 411 or buoyant bodies 413 using a wire or rope, the plurality of position adjustment means 400 may be connected quickly and easily using locking members 417 and 418 such as a velcro tape, a hook, etc.

Meanwhile, as shown in FIGS. 16E and 16F, by sealing the outside of the position adjustment means 400 including a body part 411 and a buoyant body 413 once again, it is possible to continuously provide the unique function of attenuating the impact load resulting from the fluid while extending the body part 411 and the buoyant body 413 horizontally.

Also, as shown in FIG. 16H, the position adjustment means 400 may arrange an uneven pattern 419 at the side surface of the body part 411 irregularly, thereby minimizing the sloshing of the fluid.

FIGS. 17A-17D are perspective views illustrating a position adjustment means having a curtain shape applied to the system for controlling an impact load resulting from fluid under internal/external force in a specific environment according to a preferable embodiment of the present invention.

Referring to FIGS. 17A-17D, the position adjustment means 400 having a curtain shape may be arranged in the lower direction of the floating means.

Here, as shown in FIG. 17A, the position adjustment means 400 having a curtain shape may be one single member arranged to surround a side circumference of the mat member 310 of the floating means.

In some cases, as shown in FIG. 17B, the position adjustment means 400 having a curtain shape may be a plurality of members arranged to surround a side circumference of the connecting block 310 of the floating means.

Here, when there are a plurality of members of the position adjustment means 400 having a curtain shape, the adjacent position adjustment means 400 may be arranged at a predetermined interval d.

Also, as shown in FIG. 17C, the position adjustment means 400 having a curtain shape may be arranged at a predetermined interval d from the lower surface 310*a* of the mat member 310.

Here, the position adjustment means 400 having a curtain shape may be connected to the mat member 310 by a connecting member 430.

Also, as shown in FIG. 17D, the position adjustment means 400 having a curtain shape may be formed of a plurality of holes 418.

Here, the position adjustment means 400 having a curtain shape may include at least one of phenol resin, melamine resin, and synthetic resin thereof.

FIGS. 18A-18C are perspective views illustrating a condition of the connection between a position adjustment means having a curtain shape and a floating means applied to the system for controlling an impact load resulting from fluid under internal/external force in a specific environment according to a preferable embodiment of the present invention.

As shown in FIGS. 18A-18D, the position adjustment means 400 having a curtain shape may be connected in the lower direction of the floating means 300.

Here, the position adjustment means 400 having a curtain shape may be connected to a mat member 310 using at least one of an adhesive 431 and a locking member 430.

As shown in FIG. 18B, one end of the connecting member 430 is locked to a side surface of the mat member 310, and the other end is locked to an end of the position adjustment means 400 having a curtain shape.

In some cases, the connecting member 430 may be locked to a lower surface of the mat member 310, and the other end may be locked to an end of the position adjustment means 400 having a curtain shape.

FIGS. 19A-19B are cross-sectional views illustrating an arrangement of a sensor sensing a movement of impact load of fluid applied to the system for controlling an impact load resulting from fluid under internal/external force in a specific environment according to a preferable embodiment of the present invention.

As shown in FIGS. 19A-19B, the sensing means 500 may sense a movement of an impact load of the fluid by being arranged in at least one of a floating means 300, a position adjustment means 400, and a fluid 200. The sensing means 500 may include a selective combination of at least one of an acceleration sensor 510, an inertia sensor 520, a vibration sensor 530, an acoustic sensor 540, a temperature sensor 550, a pressure sensor 560, a shape sensor 570, a strain sensor 580, and a load cell 590.

Here, a bumper plate 150 controlling the movement of the impact load of the fluid may be further arranged in an inner wall of the transportation means 100, and a sensing means 500 sensing the movement of the impact load of the fluid may be further arranged in the bumper plate 150. FIGS. 24A-24E illustrates examples of measurement data according to the acceleration sensor, temperature sensor, and pressure sensor.

Here, the acceleration sensor 510 is a sensor generating power when an object with mass receives acceleration and measuring the change in speed (acceleration) of at least one axis. It may measure dynamic power such as acceleration, vibration, impact, etc. of the floating means 300, position adjustment means 400, fluid 200 and bumper plate 150, etc.

Also, the inertia sensor 520 is a sensor detecting inertial force acting on an inertial object by the acceleration applied. It may measure the acceleration, speed, direction, distance, etc. of the measurement object, which is a moving object.

Next, the vibration sensor 530 is a sensor detecting the vibration of mechanical structures and fluid. It may measure vibration generated in the floating means 300, position adjustment means 400, fluid 200, and bumper plate 150, etc., and measure the vibration generated by the impact between the floating means 300 and transportation means 100 such as a container, etc.

Next, the acoustic sensor 540 is a sensor sensing the conversion of particle motion generated by an elastic wave into electric signals. It may receive an acoustic emission wave and convert it into an acoustic emission signal, and detect minute crevice and crack generated in the floating means 300, position adjustment means 400, fluid 200, and bumper plate 150, etc.

The temperature sensor 550 is a sensor detecting the temperature of gas, fluid and solid. It may measure the temperature varying in the floating means 300, position adjustment means 400, fluid 200, bumper plate 150, transportation means 100, etc.

Also, the pressure sensor 560 is a sensor detecting the pressure of gas or fluid. It is a sensor using heat conductivity of molecule density in addition to displacement or deformation. It may measure the change in pressure according to the capacity of fluid 200 within transportation means 100 such as a container, etc.

Next, the shape sensor 570 is a shape recognizing sensor confirming the presence, position and shape of an object. It may detect the presence, position and shape of the floating means 300, position adjustment means 400, fluid 200, bumper plate 150, transportation means 100, etc.

As such, the present invention may precisely measure the predicted occurrence of impact load of the fluid using various sensing means 500.

FIGS. 20A-20B are cross-sectional views illustrating a condition having a bumper plate installed in an inner wall of a transportation means when the system for controlling an impact load resulting from fluid under internal/external force in a specific environment according to a preferable embodiment of the present invention is installed in a transportation means.

Referring to FIGS. 20A-20B, a bumper plate 150 controlling the movement of the impact load of the fluid may be arranged in the inner wall 120 of the transportation means 100.

Here, the bumper plate 150 is fixed to a fixed axis connected to the inner wall 120 of the transportation means 100, enabling rotation movement in the up/down/left/right direction so as to change the moving direction of the fluid 200.

That is, as shown in FIGS. 20A-20B, the bumper plate 150 may rotate in the Y-axis direction and Z-axis direction.

In this case, the surface of the bumper plate 150 may be inclined in a predetermined angle with respect to the surface of the inner wall 120 of the transportation means 100.

For example, when a plurality of bumper plates 150 are arranged in the height direction of the transportation means 100, the angle between the surface of the bumper plate 150 and the inner wall 120 surface of the transportation means 100 may vary in the height direction of the transpiration means 100.

Also, the surface of the bumper plate 150 may be irregular.

As such, the reason for arranging the bumper plate 150 is to attenuate the sloshing of the fluid 200 facing the inner wall 120 of the transportation means 100 with the irregular surface of the bumper plate 150, and to minimize the sloshing by offsetting the fluids 200 having different moving directions by changing the moving direction of the fluid 200 to be irregular.

FIGS. 21A-21B are side cross-sectional views illustrating a thickness of a bumper plate installed in an inner wall of a transportation means when the system for controlling an impact load resulting from fluid under internal/external force in a specific environment according to a preferable embodiment of the present invention is installed in a transportation means.

Referring to FIGS. 21A-21B, a bumper plate 150 controlling the movement of the impact load of the fluid may be arranged in the inner wall of the transportation means 100.

Here, as shown in FIG. 21A, the thickness t of the bumper plate 150 may be constant from one end to the other end.

In this case, the surface of the bumper plate 150 may be formed of an irregular uneven pattern 150*a*.

Also, the surface of the bumper plate 150 may be inclined in a predetermined angle with respect to the inner wall surface of the transportation means 100.

In some cases, as shown in FIG. 21B, the thickness t of the bumper plate 150 may gradually gets thinner from one end to the other end.

Here, the bumper plate 150 may be controlled so that the surface facing the inner wall surface of the transportation means 100 is parallel, and the surface opposite to the inner wall surface of the transportation means 100 is inclined at a predetermined angle. That is, the bumper plate 150 is installed to be controllable in a direction selected from up, down, left and right directions by the worker, so as to effectively disperse the power applied to the transportation means 100 or maritime structure by passive fluid dynamics or motion generation of sloshing generated by being set in the up/down direction or left/right direction.

FIG. 22 is a block diagram of a control means 600 applied to the system for controlling an impact load resulting from fluid under internal/external force in a specific environment according to a preferable embodiment of the present invention. FIG. 23 is a control flow chart for explaining a control operation of the system for controlling an impact load resulting from fluid under internal/external force in a specific environment according to a preferable embodiment of the present invention.

First, referring to FIG. 22, the control mean 600 includes a sensor measuring part 610 converting a physical change of a measurement object sensed by the sensing means 500 into a digital signal and outputting the digital signal, a processor part for analysis and comparison algorithm 620 conducting structure interpretation, comparison and analysis on an impact load inside the fluid 200 and an impact load generated in the floating means 300, the position adjustment means 400, the transportation means 100 or the maritime structure by using data transmitted and measured at the sensor measuring part 610, a database 630 storing a look-up table made by making an algorithm of the result analyzed at the processor part for analysis and comparison algorithm 620, a processor for predictive diagnosis and control signal algorithm 640 predicting impact load data on a response of the transportation means 100 or the maritime structure by comparing data measured at the sensing means 500 with data on internal/external force accumulated in the look-up table stored in the database 630, and a remote monitoring and controlling part 650 remotely-controlling the driving of a control target device in the transportation means 100 by using a predictive control signal algorithm outputted from the processor for predictive diagnosis and control signal algorithm 640.

Here, the look-up table records time-serial data by the year, and the look-up table may be modified by comparing the time-serial data by the year accumulated until the previous year with the data measured through the sensing means 500.

Hereinafter, the operation of the control means is explained referring to FIG. 23.

First, the sensor measuring part 610 receives change in acceleration, inertia, vibration, sound, temperature, pressure, shape, strain, etc. of the sensed object sensed by the sensing means 500 in the fluid 200, floating means 300 and position adjustment means 400 and converts it into digital signal that may be measured (S110, S120).

The processor part for analysis and comparison algorithm 620 structurally interprets, compares and analyzes the impact load resulting from non-periodic coupled energy and response thereto occurring in the fluid 200, floating means 300 and position adjustment means 400, transportation means 100 or maritime structure by using data measured by the sensing means 500 transmitted to the sensor measuring part 610 (S130).

Next, the processor part for analysis and comparison algorithm 620 makes a look-up table with FEA (Finite Element Analysis) based simulation reflecting empirical data measured in real-time at the database 630 by making an algorithm of the analyzed result by using comparative algorithm and predictive control signal algorithm (S140, S150).

Here, making an algorithm in S140 includes backing up FEA-based simulation reflecting empirical data measured in real-time (S141), conducting FEA-based simulation storing and default setting (S143), making a database for situation recognition of external conditions of the environment and measurement results (S145), generating and storing modified log (S147), and generating report and backing up electronic file (S149).

Also, the predictive control signal algorithm in S150 includes backing up the predictive control simulation reflecting empirical data (S151), conducting FEA-based simulation storing and default setting (S153), making a database for situation recognition of driving the predictive control device (S155), generating and storing modified log (S157), and generating report and backing up electronic file (S159).

The remote monitoring and controlling part 640 remotely-controls the driving of the control target device (for example, ballast tank, tensioner, thruster, rudder, etc.) in the transportation means 100 by using a predictive control signal algorithm stored in the database 630 (S170).

Thus, the remote monitoring and controlling part 650 may control the posture or navigation path of the transportation means 100 or maritime structure using data on the predicted response of the transportation means 100 or maritime structure (S180).

The system for controlling an impact load resulting from a fluid under an internal/external force in a specific environment according to the present invention as explained in the above can minimize the impact load and boil off gas (BOG) of the fluid while efficiently sensing the impact load of various fluids including sloshing, slamming, ice collision, etc., and allow a simple and quick process of the work of connecting a plurality of mat members and maintenance thereof through a detachable member fixed to the cover of a mat member.

It will be apparent that, although the preferred embodiments have been shown and described above, the present specification is not limited to the above-described specific embodiments, and various modifications and variations can be made by those skilled in the art to which the present invention pertains without departing from the gist of the appended claims. Thus, it is intended that the modifications and variations should not be understood independently of the technical spirit or prospect of the present specification.

What is claimed is:

1. A system for controlling an impact load resulting from a fluid under an internal force or an external force in a specific environment, the system comprising:

a floating means (300) arranged horizontally inside a fluid (200) existing in an open space or in an inner space of a transportation means (100); and a position adjustment means (400) vertically connected to the floating means (300) and arranged in a preset position inside the fluid;

a sensing means (500) selectively installed inside or on the surface of the fluid (200), on the floating means (300), on the position adjustment means (400), or on a structure positioned in a periphery of the environment to sense a physical change of at least one preset measurement object; and a control means (600) for controlling at least one of fluid dynamics-related environment internal/external forces, hull stress, six-degree-of-freedom movements, and positions in connection with a transportation means (100) or a maritime structure, using the sensed value of the physical change of the at least one preset measurement object transmitted from the sensing means (500), wherein the position adjustment means (400) comprises at least one of a first floating body (410) arranged at an upper part of the floating means (300) and a second floating body (420) arranged at a lower part of the floating means (300), the first floating body (410) has a specific gravity smaller than the fluid (200) and the floating means (300), the second floating body (420) has a specific gravity greater than the fluid (200) and the floating means (300), and the floating means (300) has a specific gravity greater than the fluid (200) and the first floating body (410) and smaller than the second floating body (420).

2. The system of claim 1, wherein the floating means (300) comprises at least two mat members (310) locked to one another, and each mat member (310) comprises a body part (301) having a closed space (303) in the center of an inner portion, a buoyant body (305) arranged in the closed space (303) of the body part (301), and a cover (308)

surrounding an external surface of the body part (301) and having at least one locking member (307) fixed to the external surface at predetermined intervals.

3. The system of claim 2, wherein the plurality of mat members (310) are arranged at predetermined intervals to have a predetermined empty space, so as to re-collect evaporated fluid at an upper part of the mat members (310) in a liquid state when liquid included in the fluid (200) and the mat members (310) are sprayed between the mat members (310) by inertial motion during movement.

4. The system of claim 2, wherein identification marks (317) and (319) identifiable by an imaging device or laser are formed or attached to an upper surface of each mat member (310), so as to allow the control means (600) to measure and diagnose the position and six-degree-of-freedom movement of each mat member (310).

5. The system of claim 1, wherein each of the first floating body (410) or the second floating body (420) comprises a body part (411) having a closed space (412) in the center of an inner portion, a buoyant body (413) arranged in the closed space (412) of the body part (411), and a cover (416) surrounding an external surface of the body part (411) and having upper and lower locking members (417) and (418) fixed to an upper surface and a lower surface of the cover, respectively.

6. The system of claim 1, wherein when transporting the fluid (200) in a storage state using the transportation means (100), at least one bumper plate (150) controlling the movement of an impact load of the fluid (200) is arranged in an inner wall of the transportation means (100), and the bumper plate (150) is installed to be selectively controllable in up, down, left and right directions.

7. The system of claim 1, wherein the sensing means (500) comprises a selective combination of at least one of an acceleration sensor (510), an inertia sensor (520), a vibration sensor (530), an acoustic sensor (540), a temperature sensor (550), a pressure sensor (560), a shape sensor (570), and a strain sensor (580).

8. The system of claim 1, wherein when the floating means (300) comprises a first mat member (311) arranged in an odd number of columns and a second mat member (312) arranged in an even number of columns, the first mat member (311) and the second mat member (312) are arranged crisscross each other, and are formed in different shapes.

9. The system of claim 1, wherein the floating member (300) is lockably fixed to the transportation means (100), or floats within the fluid (200) by itself without being locked.

10. The system of claim 1, wherein at least one of the first floating body (410) and the second floating body (420) of the position adjustment means (400) is arranged irregularly.

11. The system of claim 1, wherein the first floating body (410) of the position adjustment means (400) is a floating member having a buoyant body.

12. The system of claim 1, wherein the second floating body (420) of the position adjustment means (400) is at least one of a floating member having a buoyant body and a curtain member having a curtain shape.

13. The system of claim 1, wherein when a plurality of bumper plates (150) are arranged in a height direction of the transportation means (100) or the maritime structure, an angle between a face surface of each bumper plate (150) and an inner wall surface of the transportation means or the maritime structure is different from each other in a height direction of the transportation means or the maritime structure.

14. The system of claim 13, wherein each bumper plate (150) is formed to have a thickness gradually thinner from one end to the other end.

15. The system of claim 1, wherein the first floating body (410) connected to the upper part of the position adjustment means (400) is a floating member having a buoyant body, and the second floating body (420) connected to the lower part of the position adjustment means (400) is formed of a curtain member (420*b*) formed of a phenol resin, a melamine resin, or a synthetic resin thereof.

16. The system of claim 15, wherein the curtain member (420*b*) is formed of one single member arranged to surround a side circumference of the floating means (300), or a plurality of members arranged to surround a side circumference of the floating means (300).

17. A system for controlling an impact load resulting from a fluid under an internal force or an external force in a specific environment, the system comprising:

a floating means (300) arranged horizontally inside a fluid (200) existing in an open space or in an inner space of a transportation means (100); and a position adjustment means (400) vertically connected to the floating means (300) and arranged in a preset position inside the fluid;

a sensing means (500) selectively installed inside or on the surface of the fluid (200), on the floating means (300), on the position adjustment means (400), or on a structure positioned in a periphery of the environment to sense a physical change of at least one preset measurement object; and a control means (600) for controlling at least one of fluid dynamics-related environment internal/external forces, hull stress, six-degree-of-freedom movements, and positions in connection with a transportation means (100) or a maritime structure, using the sensed value of the physical change of the at least one preset measurement object transmitted from the sensing means (500), wherein the control means (600) comprises:

a sensor measuring part (610) for converting a physical change of the at least one preset measurement object sensed by the sensing means (500) into a digital signal and outputting the digital signal;

a processor part (620) for conducting structure interpretation, and performing comparison and analysis on an impact load inside the fluid (200) and an impact load generated in the floating means (300), the position adjustment means (400), the transportation means (100) or the maritime structure by using data transmitted and measured at the sensor measuring part (610); and a database (630) for storing a look-up table made by making an algorithm of the result analyzed at the processor part (620).

18. The system of claim 17, wherein the control means (600) further comprises:

a second processor part (640) for predictive diagnosis and control signal algorithm to predict impact load data on a response of the transportation means (100) or the maritime structure by comparing data measured at the sensing means (500) with data on internal/external force accumulated in the look-up table stored in the database (630); and a remote monitoring and controlling part (650) for remote controlling the driving of a control target device in the transportation means (100) by using a predictive control signal algorithm output from the second processor part (640).

19. The system of claim 18, wherein the control target device in the transportation means (100) is a selective combination of a ballast tank, a tensioner, a thruster, and a rudder.

20. The system of claim 18, wherein the remote monitoring and controlling part (650) controls a posture or a navigation path of the transportation means (100) or the maritime structure in real-time using predicted response data on the transportation means (100) or the maritime structure.

* * * * *